US010577144B2

(12) United States Patent
Buss

(10) Patent No.: US 10,577,144 B2
(45) Date of Patent: Mar. 3, 2020

(54) REPLACEMENT PANEL ASSEMBLY FOR SEALING CARTON ASSEMBLY AND METHODS OF ASSEMBLY AND USE

(71) Applicant: FISHER CLINICAL SERVICES, INC., Allentown, PA (US)

(72) Inventor: Michael Buss, Breinigsville, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 0 days.

(21) Appl. No.: 15/785,036

(22) Filed: Oct. 16, 2017

(65) Prior Publication Data

US 2018/0105313 A1 Apr. 19, 2018

Related U.S. Application Data

(60) Provisional application No. 62/409,529, filed on Oct. 18, 2016.

(51) Int. Cl.
*B65D 5/02* (2006.01)
*B65D 5/54* (2006.01)

(52) U.S. Cl.
CPC ..... *B65D 5/0236* (2013.01); *B65D 5/54* (2013.01)

(58) Field of Classification Search
CPC ..... B65D 5/0236; B65D 5/42; B65D 5/445; B65D 5/54; B65D 5/566
See application file for complete search history.

(56) References Cited

U.S. PATENT DOCUMENTS 4,174,041 A 11/1979 Turner
4,746,052 A * 5/1988 Schmissrauter ..... B65D 5/42 206/807

(Continued)

FOREIGN PATENT DOCUMENTS

DE 75 08 653 U 9/1976
DE 94 09 968 U1 9/1994

(Continued)

OTHER PUBLICATIONS

International Search Report and Written Opinion dated Jan. 19, 2018, issued in PCT Application No. PCT/US2017/056801, filed Oct. 16, 2017.

(Continued)

*Primary Examiner* — Derek J Battisti
(74) *Attorney, Agent, or Firm* — Workman Nydegger

(57) ABSTRACT

An attachable panel assembly includes a replacement panel having a mounting panel and a closure panel projecting from the mounting panel. The closure panel has an attachment portion and a removable zipper tear strip disposed between the attachment portion and the mounting panel. The panel assembly also includes a first adhesive layer disposed on the mounting panel and a second adhesive layer disposed on the attachment portion of the replacement closure panel, the first adhesive layer and the second adhesive layer being disposed on opposing sides of the replacement panel. A resealable carton system includes the panel assembly attached or attachable to a carton body of a carton assembly by means of the first adhesive layer. The carton assembly can be sealed by closing an inner closure panel of the carton assembly and folding the replacement closure panel so that the second adhesive binds to the inner closure panel.

14 Claims, 24 Drawing Sheets

(56) References Cited

U.S. PATENT DOCUMENTS

| | | | | |
|---|---|---|---|---|
| 5,950,914 | A * | 9/1999 | Dunton | B65D 5/5405 229/122 |
| 6,199,688 | B1 * | 3/2001 | Focke | B65D 5/422 206/265 |
| 6,409,077 | B1 | 6/2002 | Telesca et al. | |
| 7,080,736 | B2 * | 7/2006 | Jackson | B65D 5/16 206/738 |
| 8,025,209 | B2 * | 9/2011 | Garner | B65D 5/18 229/120.09 |
| 8,308,363 | B2 * | 11/2012 | Vogt | B65D 75/5838 383/5 |
| 8,998,074 | B2 * | 4/2015 | Schomisch | B65D 5/32 206/736 |
| 2005/0145683 | A1 * | 7/2005 | Alagna | B65D 5/541 229/102 |
| 2014/0102934 | A1 | 4/2014 | Gatto et al. | |
| 2016/0137335 | A1 * | 5/2016 | Mora | B65D 5/0227 53/412 |
| 2016/0236811 | A1 * | 8/2016 | Jensen | B65D 5/324 |
| 2017/0057690 | A1 * | 3/2017 | Boersma | B65D 5/5014 |
| 2018/0215499 | A1 * | 8/2018 | Imai | B65D 5/5004 |

FOREIGN PATENT DOCUMENTS

| | | | |
|---|---|---|---|
| DE | 20 2012 003954 | U1 | 7/2013 |
| EP | 1 481 922 | A1 | 12/2004 |
| GB | 2 315 239 | A | 1/1998 |

OTHER PUBLICATIONS

*Handbook of Folding Carton Style Nomenclature*, Paperboard Packaging council, 1992, 4 pages.
*Fibre Box Handbook*, Fibre Box Association, 1999, 4 pages.

* cited by examiner

REPLACEMENT PANEL ASSEMBLY FOR SEALING CARTON ASSEMBLY AND METHODS OF ASSEMBLY AND USE

CROSS-REFERENCE TO RELATED APPLICATIONS

This application claims the benefit of U.S. Provisional Application No. 62/409,529, filed Oct. 18, 2016, which is incorporated herein by specific reference.

BACKGROUND

1. Technical Field

The present disclosure relates to attachable panel assemblies for sealing or resealing carton assemblies such as zipper carton assemblies.

2. Relevant Technology

Clinical trials for many pharmaceutical drugs require that a drug and a placebo be delivered and administered in a blinded study. As part of the blinded clinical trial protocols, the drug and placebo are placed in separate unmarked containers. Accordingly, the administering technician and recipient are blind as to the identity of the product, the concentration thereof, or other characteristics being studied that may otherwise be reported on the retail label of the drug container.

To facilitate transport and delivery of the drug/placebo, the unmarked containers can be sealed in a box. For instance, an unmarked dosage vial or tube can be placed in a box having a lid that can be folded over to close the box. Once the lid is closed, a sealing sticker is manually placed on the outside of the box so as to extend between the lid and the body of the box, thereby fixing the lid closed and sealing the contents therein. The unbroken sealing sticker indicates that the box has not been opened following sealing of the product therein. The box can also be marked with a label that includes an identification number or other information associated with the included product. However, this identifying information is keyed to a reference list and is only useful in identifying the product in combination with that list. Accordingly, the box may also lack any direct, product-identifying marks or labels to ensure fidelity of the blinded study.

One of the difficulties in conducting blinded trials is ensuring that there is no indirect identifying and/or associating information that can inadvertently convey to the participants information about the drug/placebo they are taking. For instance, variation between the placement (e.g., location, orientation, etc.) of the sealing stickers on the boxes can provide an indication of product identity. Specifically, differences in the placement of sealing stickers between adjacent boxes or between current and former boxes may cause a participant to infer that the products between the two boxes are different or that one box is more likely to have an active drug as opposed to a placebo. Such perceived differences can defeat the objective of the blinded trials. Because even slight differences between the human-applied sealing stickers on two separate boxes can lead the technician or recipient to believe that the containers disposed therein contain different products, controlling such perceived differences can be vital to the efficacy and fidelity of the clinical trial.

In addition, opened boxes may need to be sealed or resealed for a variety of purposes without perceived differences between sealed or resealed boxes.

It would also be desirable to have boxes that prevent sealed boxes from being improperly opened and resealed or that produce an indication of when a sealed box has been improperly opened or attempts have been made to improperly open.

Accordingly, what is needed in the art are blinded trial boxes and assemblies that overcome all or some of the above shortcomings, including products and methods for sealing, opening, and/or resealing boxes in a manner that overcomes all or some of the above shortcomings.

SUMMARY OF THE INVENTION

In a first independent aspect of the present invention, a replacement panel assembly includes:

(i) a replacement panel, comprising:

(a) a mounting panel having a first side and an opposing second side; and (b) a replacement closure panel projecting from the mounting panel, the replacement closure panel comprising:

(1) an attachment portion having a first side and an opposing second side; and (2) a removable zipper tear strip disposed between the attachment portion and the mounting panel;

(ii) a first adhesive layer disposed on the first side of the mounting panel; and (iii) a second adhesive layer disposed on the second side of the attachment portion of the replacement closure panel, the first adhesive layer and the second adhesive layer being disposed on opposing sides of the replacement panel.

In one embodiment, the mounting panel and the replacement closure panel are integrally formed as a single, continuous, unitary structure.

In another embodiment, the replacement panel is comprised of a foldable sheet having a substantially flat configuration.

In another embodiment, the replacement panel is formed of a paper material.

In another embodiment, the replacement panel has a substantially square or rectangular configuration.

In another embodiment, the removable zipper tear strip is formed by two spaced apart rows of perforations that pass at least partially through the replacement closure panel.

In another embodiment, a first removable liner is covering at least a portion of the first adhesive layer.

In another embodiment, a third adhesive layer is disposed on the first side of the mounting panel at a location spaced apart from the first adhesive layer.

In another embodiment, a visual indicator of sealed configuration is disposed on a first side of the removable zipper tear strip.

In another embodiment, the first adhesive layer and the visual sealing indicator are disposed on the same side of the replacement panel.

In another embodiment, one or more score lines are formed:

through the first adhesive layer and into the first side of the mounting panel; and/or through the second adhesive layer and into the second side of the attachment portion of the replacement closure panel.

In another embodiment, the one or more score lines do not pass through the mounting panel or the attachment portion of the replacement closure pane.

In another embodiment, the one or more score lines are cut into the first side or the second side of the mounting panel.

In another embodiment, one or more score lines are formed on the first side of the attachment portion of the replacement closure panel.

In another embodiment, the one or more score lines do not pass through the attachment portion.

In another embodiment, one or more score lines are cut into the first side of the attachment portion of the replacement closure panel.

In a sub-aspect aspect of the present invention, a sealable carton system includes:

a carton body that bounds a compartment, the carton body comprising:

an encircling sidewall;

a floor disposed at a lower end of the encircling sidewall; and an inner closure panel projecting from an upper end of the encircling sidewall; and the replacement panel assembly as recited above, the mounting panel of the replacement panel assembly being at least partially disposable within the compartment of the carton body and securable by the first adhesive layer to the encircling sidewall.

In another embodiment, the encircling sidewall comprises a front panel and a rear panel, the inner closure panel projecting from an upper end of the rear panel, and the mounting panel of the replacement panel being secured by the first adhesive layer to an inner surface of the front panel.

In another embodiment, the invention includes:

the inner closure panel having an outside face with one or more score lines being formed into the outside face; and the second adhesive layer disposed on the second side of the attachment portion being secured to the outside face of the inner closure panel so as to at least partially cover the one or more score lines.

In another embodiment, a visual indicator of unsealed configuration is disposed on an outer surface of the inner closure panel, the inner closure panel being foldable into a closed configuration, the replacement closure panel being foldable over the folded inner closure panel such that the removable zipper tear strip at least partially covers the visual indicator of unsealed configuration.

In another embodiment, the carton body further comprises a plurality of spaced apart protrusions extending from an upper end of the front panel, the plurality of protrusions comprising remnants of a removed zipper tear strip.

In a second independent aspect of the present invention, a sealable carton system includes:

a carton body that bounds a compartment, the carton body comprising:

an encircling sidewall that includes a front panel and a rear panel;

a floor disposed at a lower end of the encircling sidewall; and an inner closure panel projecting from an upper end of the rear panel; and a replacement panel comprising:

a mounting panel at least partially disposed within the compartment of the carton body and secured by a first adhesive layer to the front panel; and a replacement closure panel projecting from the mounting panel so as to be at least partially disposed outside of the compartment of the carton body.

In one embodiment, the replacement closure panel has a second adhesive layer disposed thereon.

In another embodiment, the replacement closure panel is secured to the inner closure panel by the second adhesive layer.

In another embodiment, the replacement closure panel further comprises:

an attachment portion having the second adhesive layer disposed thereon; and a removable zipper tear strip disposed between the attachment portion and the mounting panel.

In another embodiment, the invention further comprises:

the inner closure panel having an interior surface and an exterior surface; and an attachment portion of a panel having an interior surface and an exterior surface, the interior surface of the attachment portion of the panel being secured by a third adhesive layer to the exterior surface of the inner closure panel.

In another embodiment, further comprising one or more score lines being formed into the exterior surface of the inner closure panel, at least a portion of the one or more score lines being covered by the third adhesive layer.

In another embodiment, the invention further comprises:

one or more score lines being formed into the exterior surface of the attachment portion of the panel; and the attachment portion of the replacement closure panel being secured to the attachment portion of the panel by the second adhesive layer so that the second adhesive layer at least partially covers the one or more score lines formed into the exterior surface of the attachment portion of the panel.

In another embodiment, the one more score lines are cut into the exterior surface of the attachment portion of the panel.

In another embodiment, the one more score lines comprise at least one curved score line.

In another embodiment, the mounting panel and the replacement closure panel are integrally formed as a single, continuous, unitary structure.

In another embodiment, the replacement panel is comprised of a foldable sheet having a substantially flat configuration.

In another embodiment, the replacement panel is formed of a paper material.

In another embodiment, the replacement panel has a substantially square or rectangular configuration.

In another embodiment, the removable zipper tear strip is formed by two spaced apart rows of perforations that pass at least partially through the replacement closure panel.

The second aspect of the invention may also include any of the features, options and possibilities set out elsewhere in this document, including in or in association with the above first aspect or below third aspect of the invention.

In a third independent aspect of the present invention, a method for sealing a carton assembly includes:

securing a mounting panel of a replacement panel to an inner surface of an encircling sidewall of a carton body, the carton body bounding a compartment;

inwardly folding an inner closure panel projecting from the encircling sidewall of the carton body so that the inner closure panel at least partially covers an opening to the compartment; and inwardly folding a replacement closure panel of the replacement panel so that an adhesive layer disposed on the replacement closure panel binds to the inner closure panel.

In one embodiment, the replacement closure panel further comprises:

an attachment portion having the adhesive layer disposed thereon; and a removable zipper tear strip disposed between the attachment portion and the mounting panel.

In another embodiment, the zipper tear strip is removed from the attachment portion.

In another embodiment, the step of securing the mounting panel comprises:

removing a first liner overlaying an adhesive layer on a first side of the mounting panel; and pressing the mounting panel against the inner surface of the encircling sidewall so that the adhesive layer binds to the encircling sidewall.

In another embodiment, the step of inwardly folding the replacement closure panel further comprises removing a second liner overlaying the adhesive layer on the replacement closure panel.

In another embodiment, prior to the step of securing the mounting panel, the inventive method further includes:

sealing the carton body closed by securing an attachment portion of an outer closure panel projecting from the encircling sidewall to the inner closure panel by an adhesive; and unsealing the sealed carton body by removing a zipper tear strip of the outer closure panel.

In another embodiment, the step of inwardly folding the replacement closure panel comprises the adhesive layer disposed on the replacement closure panel binding directly to the attachment portion of an outer closure panel that is secured to the inner closure panel.

In another embodiment, the step of inwardly folding the replacement closure panel comprises the adhesive layer disposed on the replacement closure panel binding directly to an exterior surface of the inner closure panel.

In another embodiment, one or more score lines are formed into an exterior surface of the attachment portion of an outer closure panel, the adhesive layer binding to the exterior surface of the attachment portion of an outer closure panel so as to at least partially cover the one or more score lines.

The third aspect of the invention may also include any of the features, options and possibilities set out elsewhere in this document, including in or in association with the above first or second aspect of the invention.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION

Figure 1:
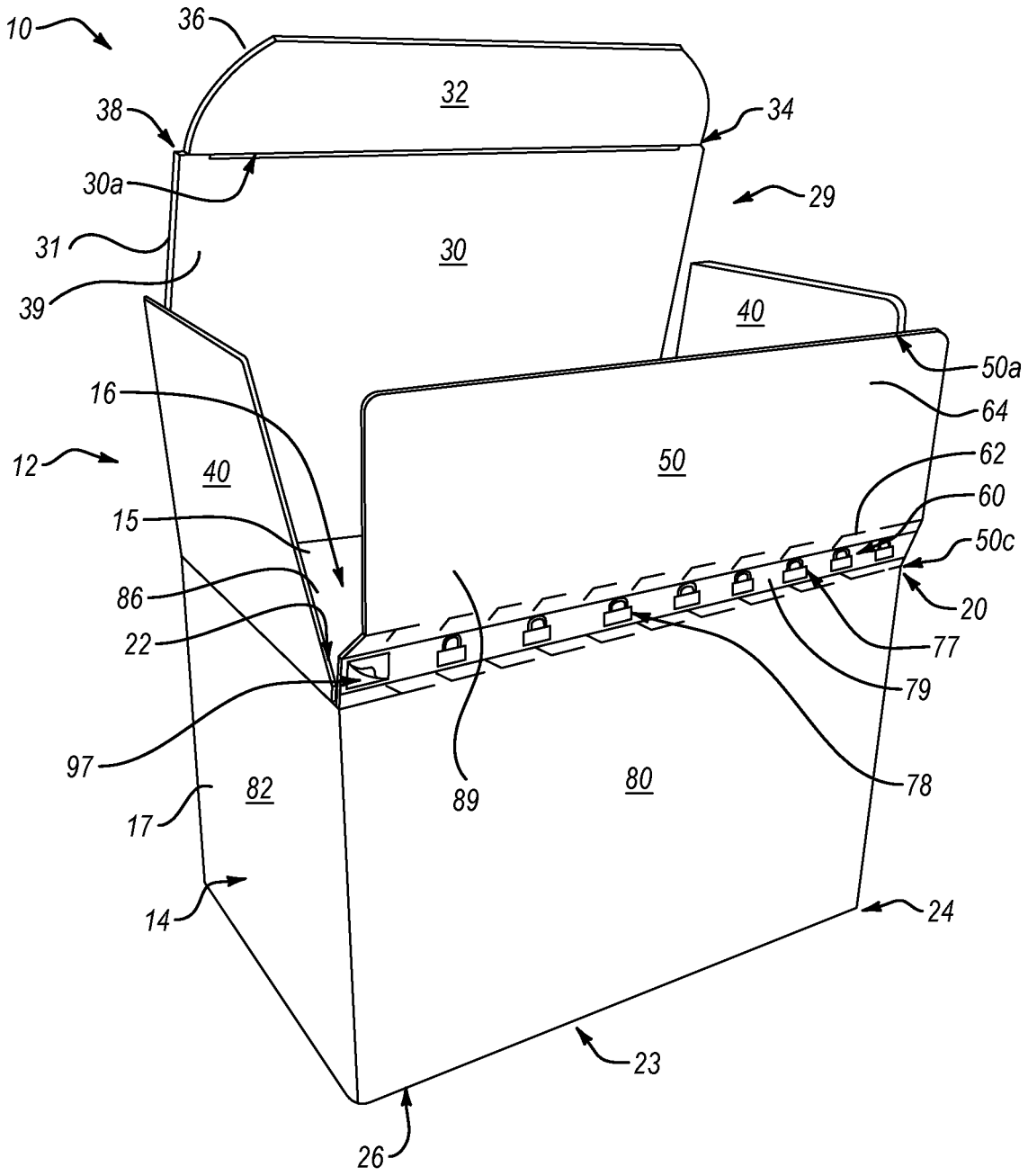
FIG. 1 is a front perspective view of a zipper carton assembly in an erected and opened configuration incorporating features of the present disclosure.

Before describing various embodiments of the present disclosure in detail, it is to be understood that this disclosure is not limited to the specific parameters and description of the particularly exemplified systems, methods, and/or products that may vary from one embodiment to the next. Thus, while certain embodiments of the present disclosure will be described in detail, with reference to specific configurations, parameters, features (e.g., components, members, elements, parts, and/or portions), etc., the descriptions are illustrative and are not to be construed as limiting the scope of the present disclosure and/or the claimed invention. In addition, the terminology used herein is for the purpose of describing the embodiments, and is not necessarily intended to limit the scope of the present disclosure and/or the claimed invention.

Unless defined otherwise, all technical and scientific terms used herein have the same meaning as commonly understood by one of ordinary skill in the art to which the present disclosure pertains.

Various aspects of the present disclosure, including systems, methods, and/or products may be illustrated with reference to one or more embodiments or implementations, which are exemplary in nature. As used herein, the terms "embodiment" and "implementation" mean "serving as an example, instance, or illustration," and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the description thereof.

As used herein, the term "systems" also contemplates devices, apparatus, compositions, assemblies, kits, etc., and vice versa. Similarly, the term "method" also contemplates processes, procedures, steps, etc., and vice versa. Moreover, the term "products" also contemplates devices, apparatus, compositions, assemblies, kits, etc., and vice versa, and so forth.

As used throughout this disclosure, the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

As used in this specification and the appended claims, the singular forms "a," "an" and "the" each contemplate, include, and specifically disclose both the singular and plural referents, unless the context clearly dictates otherwise. For example, reference to an "adhesive strip" contemplates and specifically discloses one, as well as two or more adhesive strips. Similarly, use of a plural referent does not necessarily require a plurality of such referents, but contemplates, includes, and specifically discloses one, as well as two or more of such referents, unless the context clearly dictates otherwise.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some embodiments.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

To facilitate understanding, like references (i.e., like naming and/or numbering of components and/or elements) have been used, where possible, to designate like components and/or elements common to the written description and/or figures. Specifically, in the exemplary embodiments illustrated in the figures, like structures, or structures with like functions, have been provided with similar reference designations, where possible. Specific language is also used herein to describe the exemplary embodiments. Nevertheless, it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, a description of the labeled element without the use of an appended letter can generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise specifically disclosed and contemplated herein. Thus, disclosure of an illustrative measurement (e.g., length, width, thickness, etc.) that is less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

The headings used herein are for organizational purposes only and are not meant to be used to limit the scope of the description or the claims. Moreover, while the detailed description is separated into sections, the section headers and contents within each section are not intended to be self-contained descriptions and embodiments. Rather, the contents of each section within the detailed description are intended to be read and understood as a collective whole where elements of one section may pertain to and/or inform other sections. Accordingly, embodiments specifically disclosed within one section may also relate to and/or serve as additional and/or alternative embodiments in another section having the same and/or similar systems, devices, methods, and/or terminology.

In general, embodiments of the present disclosure relate to products and methods for sealing, opening, and/or resealing cartons in accordance with one or more aspects of the present disclosure. Certain embodiments of the present disclosure are directed to zipper carton assemblies that are designed to receive a blinded trial product, and to methods of using the same. The zipper carton assembly includes a carton body, which can have a box shaped configuration having an inner compartment for receiving the blinded trial product. An adhesive layer, such as in the form of an adhesive strip, is disposed on a lid of the carton body for sealing the lid closed. The adhesive layer is disposed on an interior surface of the lid so that it is not visible when the lid is sealed closed. A removable liner covers at least a portion of the adhesive layer so that the carton body can be manipulated and prepared to receive the product without inadvertently engaging the adhesive layer. In addition, the carton body can be configured with a removable zipper tear strip to open the carton body after the lid is sealed closed so as to commence the blinded trial. The carton body can also be formed with an automatic folding floor that flattens into position upon erection of the carton body.

Accordingly, some embodiments of the zipper carton assembly described herein can comprise a pre-assembled and/or erectable, disposable, sealable, single use box adapted for assembling a blinded clinical trial kit. The zipper carton assembly can be configured to receive one or more blinded trial products therein and can be erectable and sealable without the application of any additional adhesive or sealing agent. For instance, the zipper carton assembly can be sealed in a secure manner without the use of external and/or additional sealing tape or stickers. Such sealing tape or stickers are typically undesirable because they can distinguish a carton assembly that includes an active trial product from a carton assembly that includes a placebo trial product and thus influence a blinded trial.

Various embodiments of the zipper carton assembly described herein can include a removable liner that covers the adhesive sealing layer, allowing the zipper carton assembly and/or zipper carton assembly template to be manufactured, formed, etc. at a first time and (thereafter) assembled, erected, and/or sealed at a second time. In addition, certain embodiments of the zipper carton assembly described herein can be assembled, erected, formed, manipulated, etc. without the use of any adhesive material. For instance, some embodiments can include zipper carton assembly templates that can be assembled, erected, formed, manipulated, etc. into a self-supporting zipper carton assembly without gluing a first portion of the zipper carton assembly template to a second portion of the zipper carton assembly template. It will be appreciated that such embodiments can still include an adhesive layer for sealing the zipper carton assembly upon being assembled, erected, formed, manipulated, etc. without negating the above-recited benefit and/or otherwise departing from the present disclosure.

Certain embodiments of the present disclosure relate to attachable panel systems, including attachable panel assemblies and sealable carton systems incorporating the same. Some embodiments include an attachable replacement panel assembly. The panel assembly can include an attachable replacement panel having (i) a mounting panel with a first side and an opposing second side and (ii) a replacement closure panel projecting from the mounting panel. The closure panel can include (i) an attachment portion with a first side and an opposing second side and (ii) a removable zipper tear strip disposed between the attachment portion and the mounting panel. The panel assembly can also include a first adhesive layer disposed on the first side of the mounting panel and/or a second adhesive layer disposed on the second side of the attachment portion of the replacement closure panel. In some embodiments, the first adhesive layer and the second adhesive layer can be disposed on opposing sides of the replacement panel.

Some embodiments can include a sealable (or re-sealable) carton system that includes a carton body and a replacement panel attached to the carton body. The carton body can bound a compartment and can comprise (i) an encircling sidewall that includes a front panel and a rear panel, (ii) a floor disposed at a lower end of the encircling sidewall, and/or (iii) an inner closure panel projecting from an upper end of the rear panel. The replacement panel can include (i) a mounting panel at least partially disposed within the compartment of the carton body and secured by an adhesive to the front panel, and (ii) a replacement closure panel projecting from the mounting panel so as to be at least partially disposed outside of the compartment of the carton body.

Some embodiments can include a method for sealing a carton assembly. The method can include (i) securing a mounting panel of a replacement panel to an interior surface of an encircling sidewall of a carton body that bounds a compartment, (ii) inwardly folding an inner closure panel projecting from the encircling sidewall of the carton body so that the inner closure panel at least partially covers an opening to the compartment, and (iii) inwardly folding a replacement closure panel of the replacement panel so that an adhesive disposed on the replacement closure panel binds to the inner closure panel.

Thus, embodiments of the present disclosure provide a variety of advantages above and/or over known containers and/or provide unique solutions to problems in the art not otherwise addressed by existing containers. Various embodiments will now be discussed in further detail with reference being made to the Figures of the present disclosure.

Illustrative Zipper Carton Assemblies

Figure 2:
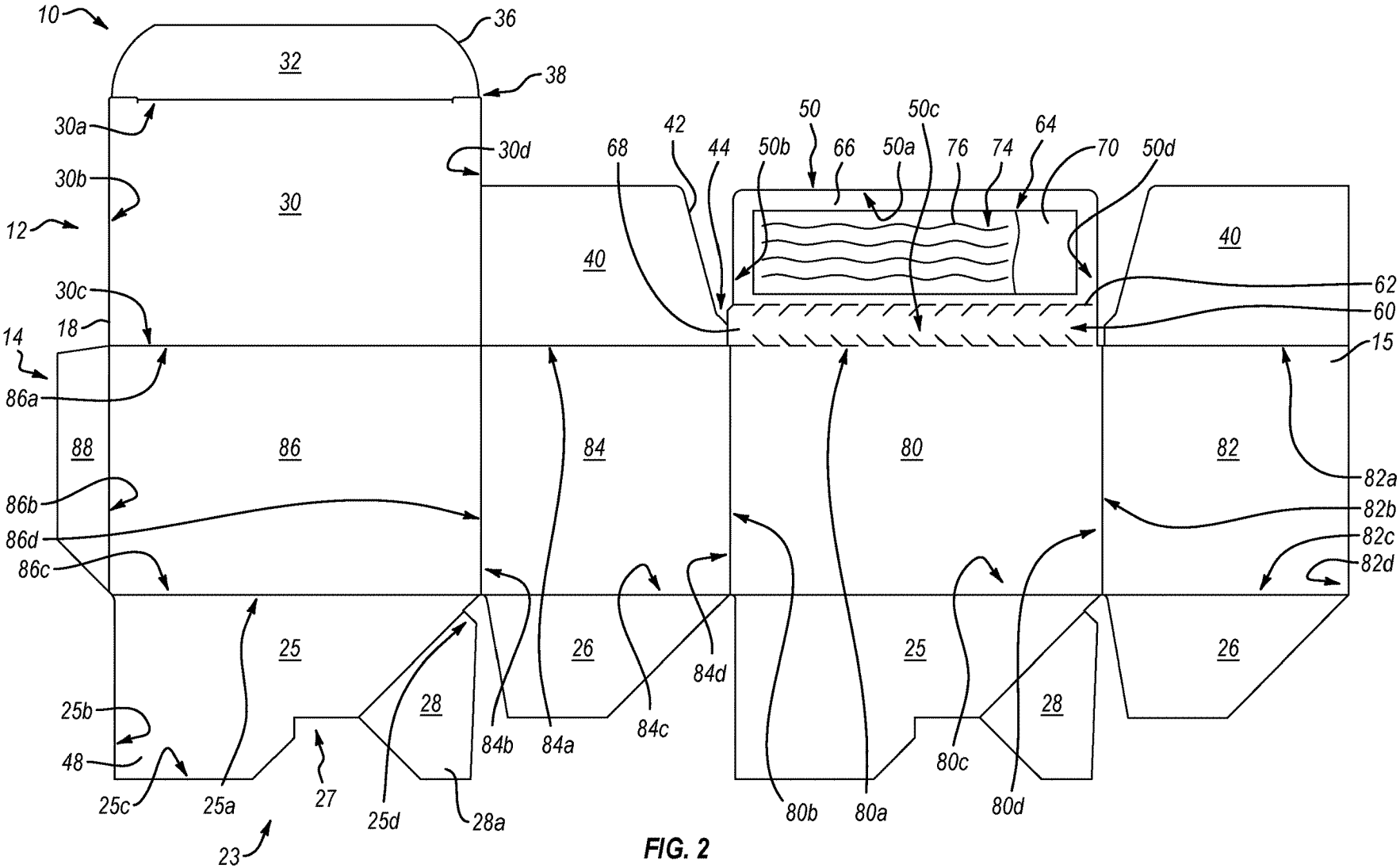
FIG. 2 is a top plan view of the zipper carton assembly shown in FIG. 1 in a flat, disassembled condition.

Depicted in FIGS. 1 and 2 is one embodiment of a zipper carton assembly 10 incorporating features of the present disclosure. Zipper carton assembly 10 generally comprises a carton body 12, an adhesive layer 70, and a removable liner 74 covering at least a portion of adhesive layer 70. Additional details of the various components in accordance with some embodiments of zipper carton assembly 10 will now be described in further detail.

As discussed below in more detail, carton body 12 can be comprised of and/or formed from a foldable sheet of material. For instance, FIG. 2 depicts carton body 12 in a flat disassembled configuration. Specifically, carton body 12 is shown as a template 18 that has been cut, such as through a die press or otherwise formed, so that it can be folded and secured into the box shape configuration as depicted in FIG. 1. Carton body 12 can be comprised of a foldable sheet of material that typically retains a crease when folded. For example, the sheet can comprise a paper-based material, such as paper, cardstock, paperboard or cardboard. In other embodiments, the sheet can be comprised of a synthetic, plastic, or other material (e.g., adapted to retain a crease when folded). The sheet can comprise a single, continuous, unitary structure; a composite; a laminate, an extrusion, or a base sheet having a coating on one or both opposing sides thereof. Template 18 can also be formed of two or more sheets that are connected together, such as through an adhesive or welding.

Carton body 12/template 18 can have a thickness suitable for various embodiments of zipper carton assembly 10. For instance, carton body 10 can have a thickness of up to, at least, or about 0.25 mm, 0.5 mm, 1 mm, 1.5 mm, 2 mm, 2.5 mm, 3 mm, and/or 5 mm or between any two of the foregoing. Thicknesses less than 0.25 mm or greater than 5 mm are also contemplated herein. In addition, various components of carton body 10 may have varying or different thicknesses in some embodiments.

With continued reference to FIGS. 1 and 2, carton body 12 of zipper carton assembly 10 generally includes an encircling side wall 14, a floor 23, and a covering 29 that bound an inner compartment 16. Encircling side wall 14 has an inner surface 15 that at least partially bounds compartment 16, an exterior surface 17 opposite inner surface 15, an upper end 20 that bounds an access opening 22 to compartment 16, and an opposing lower end 24 connected to floor 23. Encircling side wall 14 comprises a front panel 80 and an opposing rear panel 86 that both extend between a first side panel 82 and an opposing second side panel 84. Each of panels 80, 82, 84, and 86 have an upper edge 80*a*, 82*a*, 84*a*, and 86*a*, respectively, at upper end 20 of side wall 14 and a lower edge 80*c*, 82*c*, 84*c*, and 86*c*, respectively, at lower end 24 of side wall 14. Panels 80, 82, 84, and 86 also have opposing side edges 80*b* and 80*d*, 82*b* and 82*d*, 84*b* and 84*d*, and 86*b* and 86*d*, respectively.

Encircling side wall 14 can also comprise an attachment flap 88 in some embodiments. As depicted in FIG. 2, for instance, attachment flap 88 can be disposed on (e.g., connected to and/or extending from) first side 86*b* of panel 86. During assembly, attachment flap 88 can be secured to the interior surface of side panel 82, such as by an adhesive or mechanical engagement, so that encircling side wall 14 forms a continuous loop having a substantially rectangular transverse cross section as shown in FIG. 1. It is noted that between each adjacent elements of carton body 12 where one element is designed to be folded relative to the other, such as between adjacent panels or between a panel and an adjacent tab or flap, a crease is formed in the sheet material so as to enable smooth and straight folding between the elements.

Figure 10:
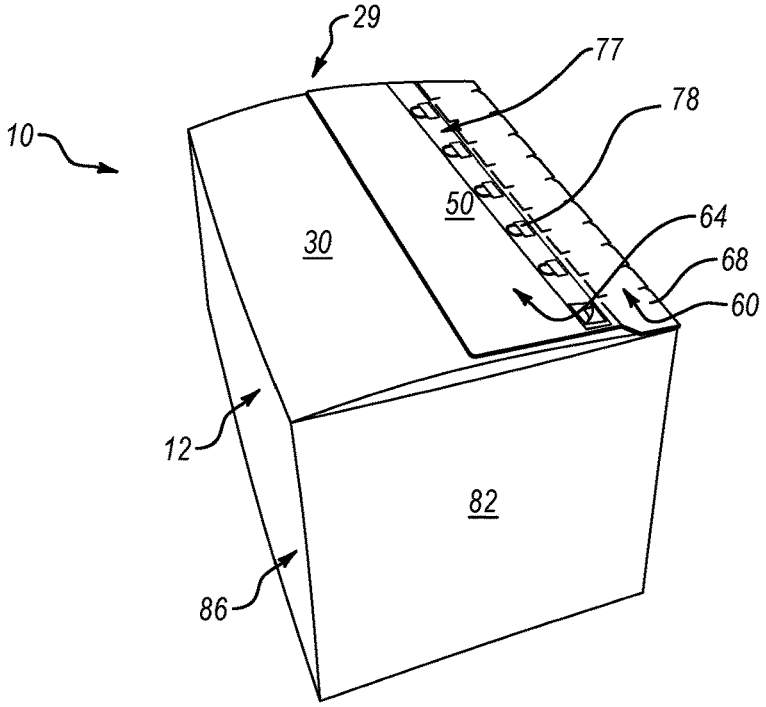
FIG. 10 is a top perspective view of the zipper carton assembly of FIG. 7 in a closed and sealed configuration.

As illustrated in FIG. 10, the final fully assembled and closed carton body 12 can have a box shaped configuration, i.e., a parallelepiped hexahedron, having square or rectangular panels. Accordingly, with reference to FIGS. 1 and 2, panels 80, 82, 84, and 86 can be disposed at successive right angles one to another. In other embodiments, carton body 12 can have other hexahedron or polyhedron configurations or other three dimensional configurations such as cylindrical or conical. As such, encircling side wall 14 can have circular, oval, or other geometric transverse cross sectional configurations.

Figure 5:
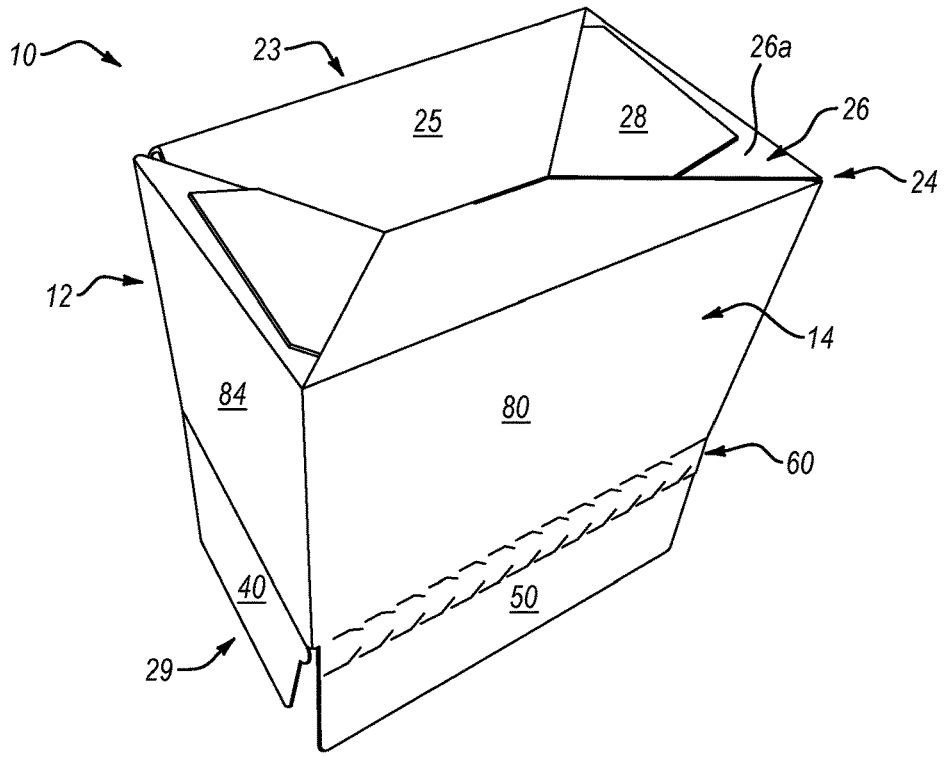
FIG. 5 is a bottom perspective view of the zipper carton assembly of FIG. 1.

As indicated above and depicted in FIG. 5, carton body 12 also includes a floor 23 disposed at lower end 24 of encircling side wall 14. It will be appreciated that floor 23 can have a variety of suitable configurations as known in the art and/or described herein. For instance, floor 23 can comprise one or more floor panels configured to cover bottom end 24 of side wall 14. As depicted in FIG. 2, floor 23 comprises opposing floor panels 25 extending, respectively, from lower edges 80*c* and 86*c* of side wall panels 80 and 86, respectively, and opposing floor panels 26 extending, respectively, from lower edges 82*c* and 84*c* of side wall panels 82 and 84, respectively.

Floor panels 25 are identical to each other and each have an outside edge 25*a* (connected to lower edge 80*c*, 86*c* of side wall panel 80, 86, respectively) and an opposing inside edge 25*c*, each extending between opposing side edges 25*b* and 25*d*. In at least one embodiment, opposing side edges 25*b* and 25*d* can be (substantially) aligned with opposing side edges 80*b* and 80*d*, 86*b* and 86*d*, respectively, of side wall panel 80, 86, respectively (i.e., substantially aligned with the opposing side edges of the side wall panel from which it extends).

It will be appreciated that "substantially" aligned, and similar terms as used herein, refers to an alignment suitable for a zipper carton assembly as described herein. For instance, substantially aligned edges can be either exactly aligned or slightly off-set in alignment.

In one or more embodiments, inside edge 25*c* can comprise a recessed notch 27 and an adjacent outwardly projecting engagement tab 48. Floor panels 25 can also comprise an attachment flap 28 disposed between recessed notch 27 and side edge 25*d*. Attachment flap 28 has an inner surface 28*a* that can be secured to an outer surface 26 (see FIG. 5) of floor panel 26.

Floor panels 26 can also be identical in configuration and can have an outside edge (connected to lower edge 82*c*, 84*c* of side panels 82, 84, respectively) and an opposing inside edge, each extending between opposing side edges. In at least one embodiment, floor panels 26 can have a trapezoidal configuration. Accordingly, the side edge(s) of floor panels 26 can (each) extend at an acute angle from the lower edge of the side wall panel from which the floor panel 26 extends.

Figure 3:
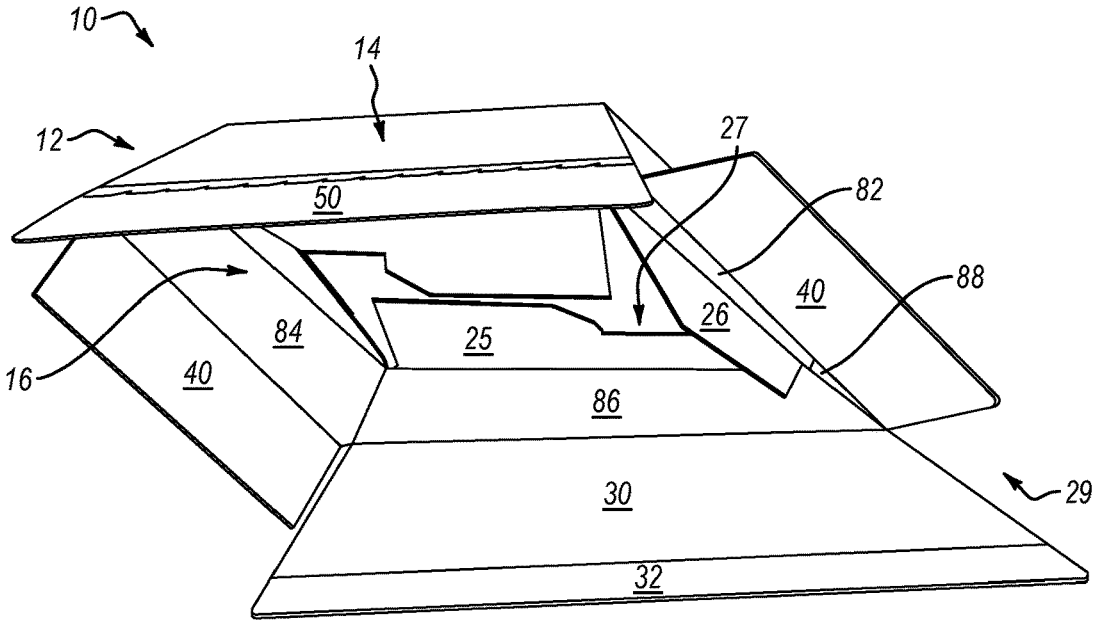
FIG. 3 is a top perspective view of the zipper carton assembly of FIG. 1 in a partially erected configuration.
Figure 4:
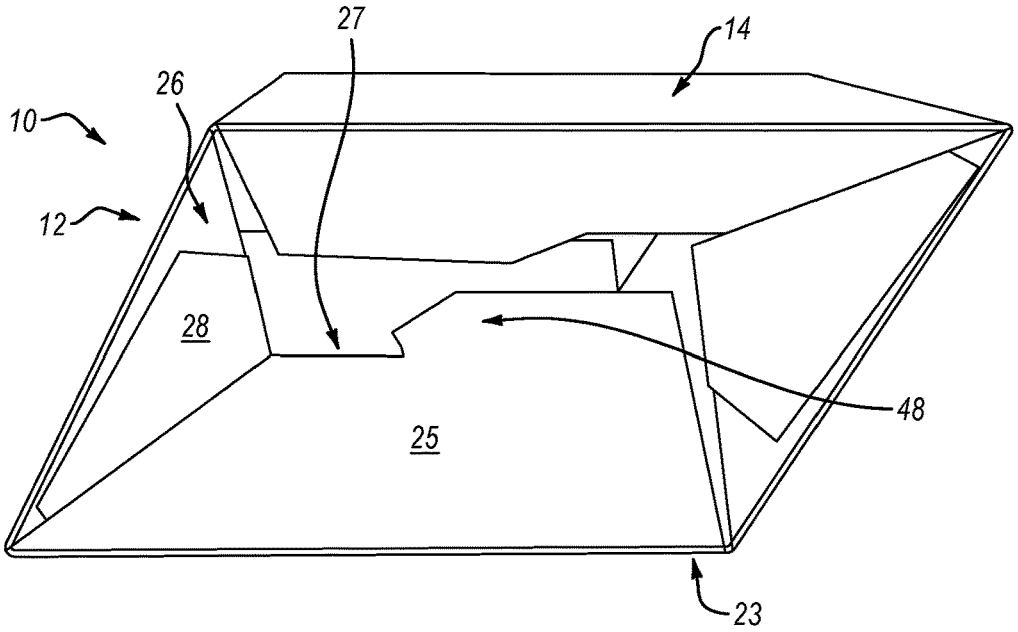
FIG. 4 is a bottom perspective view of the zipper carton assembly of FIG. 3.

Floor panels 25 and 26 are configured to produce an automatic folding floor. Specifically, during assembly of carton body 12, floor 23 can be assembled by attaching floor panel attachment flap 28 of each floor panel 25 to the floor panel 26 (immediately) adjacent to the attachment flap 28, thereby forming opposing sub-floors. In particular, inner surface 28*a* of floor panel attachment flap 28 can be secured to outer surface 26*a* of floor panel 26 (see FIGS. 4 and 5). Attachment flap 88 can be (permanently) bonded to side wall panel 82 and/or floor panel attachment flap 28 can be (permanently) bonded to floor panel 26 by way of an adhesive material (e.g., glue, tape, etc.). The assembled sub-floors are inwardly folded into compartment 16 of carton body 12 as depicted in FIGS. 3 and 4 so that carton body 12 can be folded flat into the collapsed configuration as depicted in FIG. 6.

Figure 6:
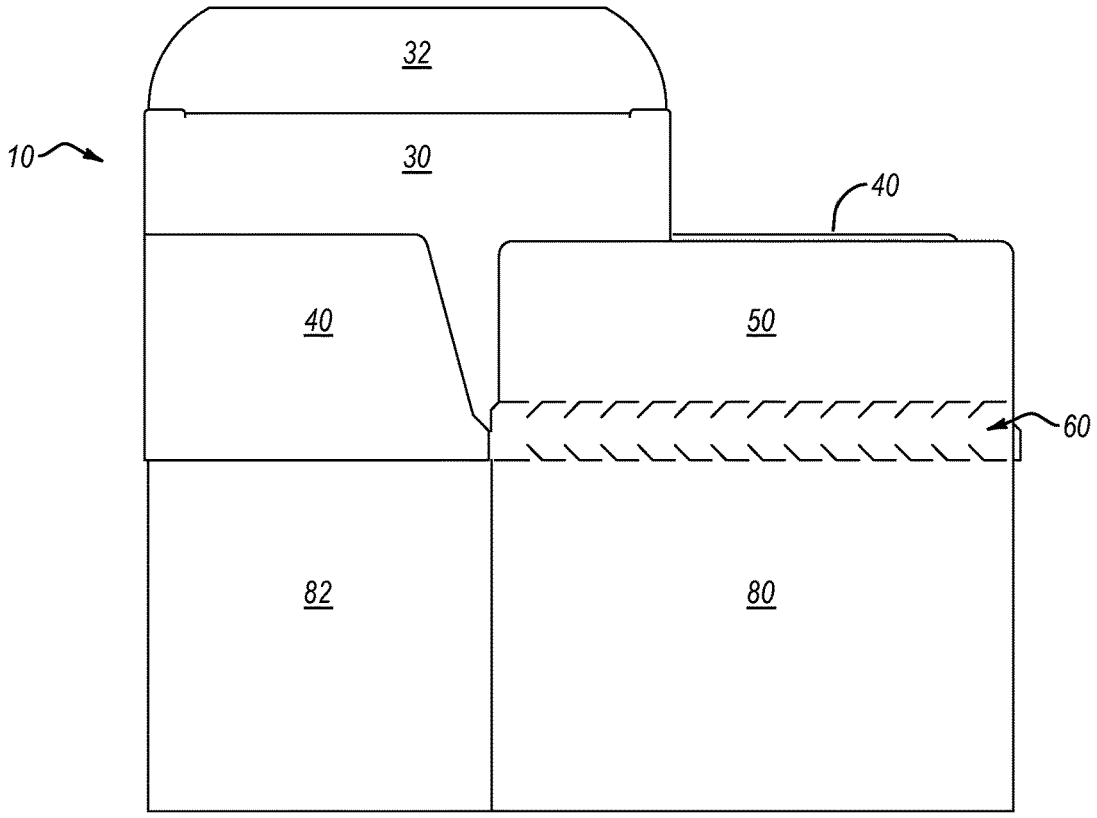
FIG. 6 is a facing view of the zipper carton assembly of FIG. 1 in a collapsed configuration.

During use, carton body 12 is manipulated from the collapsed position shown in FIG. 6 to the erected position as shown in FIGS. 1 and 5. To move to the erected position, encircling side wall 14 is pressed into the box shaped configuration. In so doing, the sub-floors that are folded and collapsed within compartment 16, as depicted in FIGS. 3 and 4, automatically unfold with engagement tabs 48 of floor panels 25 inserting into recessed notches 27 of the opposing floor panels 25 so that engagement tabs 48 interlock and produce the substantially flat floor 23 as depicted in FIG. 5.

Carton body 12 can thus be selectively moved between the collapsed configuration shown in FIG. 6, wherein carton body 12 is substantially flat, and the erected configuration shown in FIGS. 1 and 5, wherein encircling side wall 14 has a substantially rectangular transverse cross section, and vice versa. During the transformation, assembled (automatic folding) floor 23 automatically moves from the collapsed position shown in FIG. 6, through the transition position shown in FIGS. 3 and 4, erected position shown in FIGS. 1 and 5. The process can also be reversed by pressing floor 23 upward into compartment 16 (as illustrated in FIGS. 3 and 4) as carton body 12 is moved to the collapsed position. Thus, floor 23 can automatically fold into an orientation that is substantially perpendicular to encircling side wall 14 as carton body 12 is moved from the collapsed configuration to the erected position. One of the benefits of automatic folding floor 23 is that it does not require any addition adhesive, sealing tape or stickers to maintain floor 23 in the erected position shown in FIG. 5 after it is moved to the erected position. However, in other embodiments, floor 23 need not be an automatic folding floor and other conventional floors could be used.

Returning to FIG. 1 and as indicate above, carton body 12 also includes a covering 29. Covering 29 can project and/or extend from upper end 20 of encircling side wall 14 (e.g., adjacent to access opening 22 to compartment 16). In at least one embodiment, covering 29 can comprise a plurality of covering panels extending, respectively, from upper edges 80*a*, 82*a*, 84*a*, and 86*a* of side wall panels 80, 82, 84, and 86. For instance, as depicted in the FIGS. 1 and 2, covering 29 comprises an inner top closure panel 30 that projects or extends from upper edge 86*a* of side wall panel 86. In particular, inner top closure panel 30 has an outer surface 31 and an opposing inner surface 39 that extend between an inside edge 30*c* (connected to upper edge 86*a* of side wall panel 86) and an opposing outside edge 30*a*, and extend between opposing side edges 30*b* and 30*d*. In at least one embodiment, opposing side edges 30*b* and 30*d* can be (substantially) aligned with opposing side edge 86*b* and 86*d*, respectively, of side wall panel 86.

Figure 8:
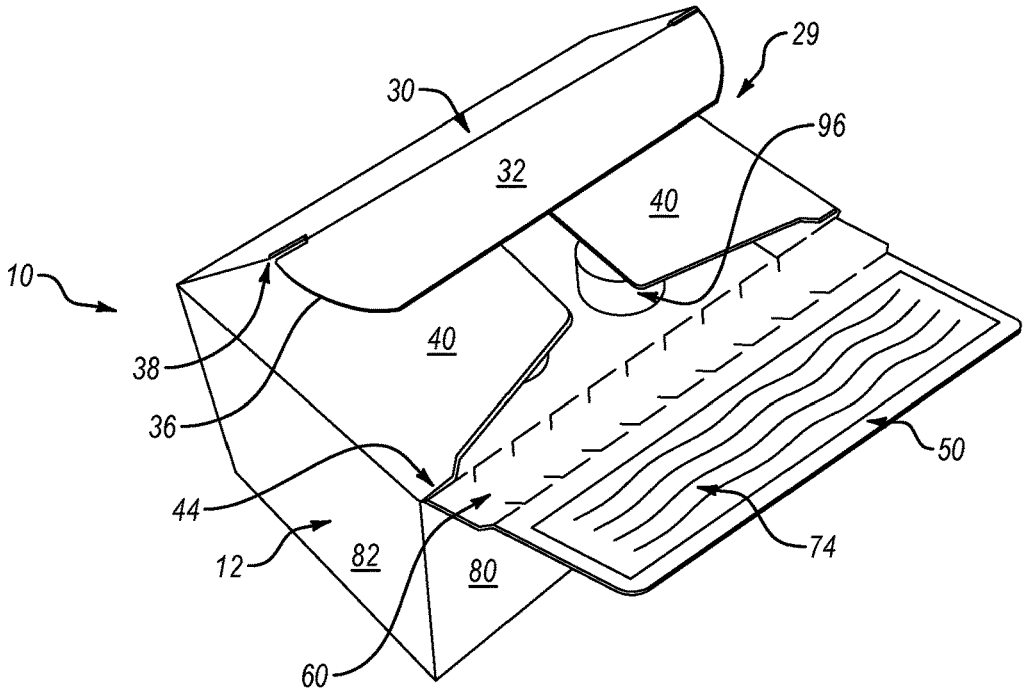
FIG. 8 is a top perspective view of the zipper carton assembly of FIG. 7 in a partially closed configuration.
Figure 9:
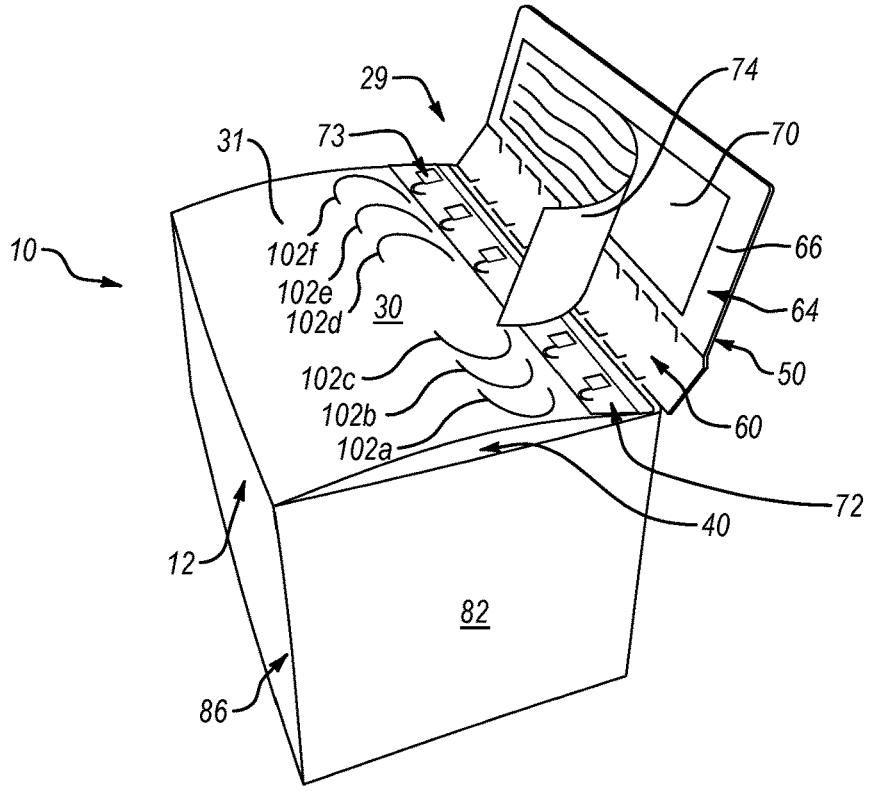
FIG. 9 is a top perspective view of the zipper carton assembly of FIG. 7 in a closed and unsealed configuration.

As illustrated in FIGS. 8 and 9 and discussed in further detail below, inner top closure panel 30 is foldable into a closed position to selectively cover at least a portion of access opening 16. Accordingly, as depicted in FIGS. 1 and 2, a foldable tuck flap 32 can be formed extending from outside edge 30*a* of inner top closure panel 30. Tuck flap 32 can have opposing rounded side edges 36 and slits 38 extending along a crease formed therebetween for easy insertion into access opening 22 and/or compartment 16 and/or secure retention therein. Other embodiments can lack slits 38 and/or have side edges 36 that are other than rounded without departing from the scope of this disclosure.

Returning to FIGS. 1 and 2, carton body 12 also includes optional opposing dust flaps 40 projecting from upper end 20 of side wall 14 (e.g., from the respective upper edges 82*a* and 84*a* of side wall panels 82 and 84, respectively). Each dust flap 40 is also selectively foldable into a closed position to cover at least a portion of access opening 22 (see FIG. 8). As depicted in FIG. 2, each dust flap 40 can have a slanted or recessed edge 42 that terminates at a tuck flap engagement tab 44. Tuck flap engagement tabs 44 are configured to capture tuck flap 32 when inner top closure panel 30 and dust flaps 40 are moved into the closed position, thereby holding inner top closure panel 30 in the closed position. In other embodiments, however, edge 42 need not be slanted and/or engagement tabs 44 can be eliminated.

Continuing with FIGS. 1 and 2, carton body 12 also includes an outer top closure panel 50 that projects from upper end 20 of side wall 14 opposite inner top closure panel 30. In particular, outer top closure panel 50 has an outer surface 89 and an inner surface 66 that extend between an inside edge 50*c* (connected to upper edge 80*a* of side wall panel 80) and an opposing outside edge 50*a*, and that extend between opposing side edges 50*b* and 50*d*. In at least one embodiment, opposing side edges 50*b* and 50*d* can be (substantially) aligned with opposing side edges 80*b* and 80*d*, respectively, of side wall panel 80. In at least one embodiment, at least a portion of opposing side edges 50*b* and 50*d* can be narrower than opposing side edges 80*b* and 80*d*, respectively, of side wall panel 80.

Figure 11:
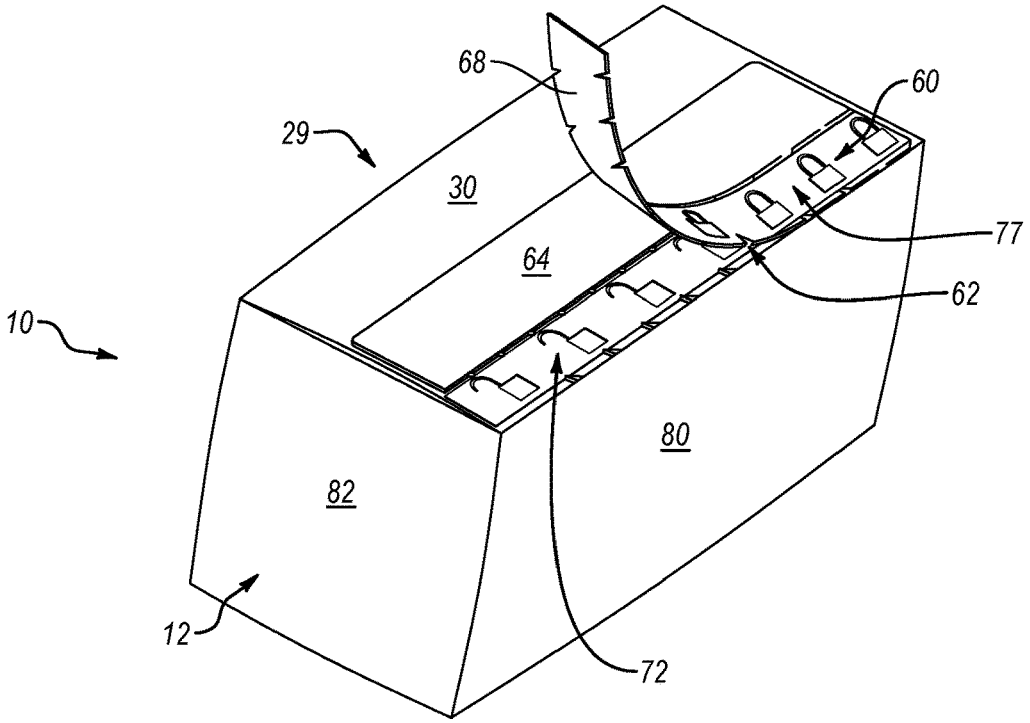
FIG. 11 is a top perspective view of the zipper carton assembly of FIG. 10 in a partially unzipped configuration.

Outer top closure panel 50 comprises an attachment portion 64 and a removable zipper tear strip 60 formed between attachment portion 64 and inside edge 50*c*. Removable zipper tear strip 60 comprises an integral portion of outer top closure panel 50 and is formed by producing two spaced apart rows of perforations 62 that are aligned between and substantially extend between side edges 50*b* and 50*d*. In the embodiment depicted, perforations 62 have a substantially V-shaped configuration with one leg linearly extending along the length of the row and the other leg sloping to the center between the rows. In other embodiments, perforations 62 can have different configurations. Perforations 62 are linearly spaced apart and typically extend completely through outer top closure panel 50. In at least one embodiment, removable zipper tear strip 60 can be disposed at or adjacent to inside edge 50*c* of outer top closure panel 50. By outwardly pulling on one end of zipper tear strip 60, the small sections of outer top closure panel 50 disposed between adjacent perforations 62 are torn through, thereby enabling zipper tear strip 60 to be removed from outer top closure panel 50 as depicted in FIG. 11. The removal of zipper tear strip 60 causes separation and/or disconnection of outer top closure panel 50 (directly) from encircling side wall 14 and, more specifically from front panel 80 thereof.

As further depicted in FIG. 1, some embodiments of the present disclosure can include a sealed indicator 77 that notifies a user by visual indication that carton body 12 is in a sealed closed configuration. For instance, a sealed indicator 77 can be disposed on the outer or exterior surface of the zipper tear strip 60. The sealed indicator 77 can comprise letters, words, symbols, icons, figures or other indicia that signify that carton body 12 is sealed closed. As depicted, for example, the sealed indicator 77 can comprise a plurality of closed padlock icons 78 extending across the length of the zipper tear strip 60.

Sealed indicator 77 can be attached to zipper tear strip 60 by being printed, embossed, pressed, attached, such as by an adhesive, or otherwise formed on or secured to zipper tear strip 60. Thus, in one embodiment, sealed indicator 77 can comprise a strip of material 70, such as a strip of tape or sticker, having indicia on one side and an adhesive for attachment on the opposing side.

In at least one embodiment, sealed indicator 77 (such as the closed padlock icons 78) can be color-coordinated to indicate a sealed configuration. For example, the closed padlock icons 78 (or other visual sealed indicator 77) can be colored green or any suitable color, in some embodiments. Indeed, in some embodiments, the visual sealed indicator 77 can (simply) be or comprise a (green or other) color or (green or other) colored element.

In addition, the sealed indicator 77 can include an instructional indicator 97. The instructional indicator 97 can comprise an illustration of a removing (or peeling) process or methods. The instructional indicator 97 can be disposed on lifting tab 68 in some embodiments, thereby indicating or emphasizing the lifting tab 68.

As depicted in FIG. 9, some embodiments of the present disclosure can also include an unsealed indicator 72 that notifies a user by visual indication that carton body 12 is in an unsealed open configuration. For instance, unsealed indicator 72 can be disposed on the outer surface 31 of the inner top closure panel 30 so that when zipper strip 60 is removed, unsealed indicator 72 is openly exposed. The unsealed indicator 72 can comprise any letters, words, symbols, icons, figures or other indicia that signifies that carton body 12 is unsealed and thus can be opened. As depicted, for example, the unsealed indicator 72 comprises a plurality of opened padlock icons 73 extending across the length of (the outer surface 31 of) the inner top closure panel 30, adjacent the zipper tear strip 60.

Unsealed indicator 72 can be attached to inner top closure panel 30 by being printed, embossed, pressed, attached, such as by an adhesive, or otherwise formed on or secured to inner top closure panel 30. Thus, in one embodiment, unsealed indicator 72 can comprise a strip of material, such as a strip of tape or sticker, having indicia on one side and an adhesive for attachment on the opposing side.

In at least one embodiment, the opened padlock icons 73 (or other visual unsealed indicator 72) can be color-coordinated to indicate an unsealed configuration. For example, the opened padlock icons 73 (or other visual unsealed indicator 72) can be colored red or any suitable color, in some embodiments. Indeed, in some embodiments, the visual unsealed indicator 72 can simply be or comprise a (red or other) color or (red or other) colored element.

Returning now to FIGS. 1 and 2, attachment portion 64 is disposed on a side of the zipper tear strip 60 remote from inside edge 50*c* of outer top closure panel 50. In at least one embodiment, at least a part of attachment portion 64 can be narrower (e.g., between opposing side edges 50*b* and 50*d*) then side wall panel 80 (e.g., between opposing side edges 80*b* and 80*d*). Attachment portion 64 can have inner surface 66 that is planar and can extend continuous with inner surface 15 of encircling side wall 14. Accordingly, as depicted in FIG. 2, inner surface 66 of attachment portion 64 and inner surface 15 of side wall 14 can be disposed on the same side of carton body 12.

As further depicted in FIG. 2, adhesive layer 70 of zipper carton assembly 10 can be disposed on inner surface 66 of attachment portion 64/outer top closure panel 50. In at one embodiment, adhesive layer 70 can comprise a layer of glue or adhesive, double sided tape, and/or other sticky- or tacky-type material. For instance, adhesive layer 70 can comprise a synthetic rubber adhesive or rubberized glue adapted for permanent bonding and/or adhesion to plastic, paper, and/or other suitable material. Accordingly, adhesive layer 70 can have a strong initial tack for creating a permanent bond between two portions of carton body 12. Those skilled in the art will appreciate that a "permanent bond" as used herein refers to a secure adhesion of two components intended for permanent association and does not necessarily imply physical inability to separate the two components.

In at least one embodiment, adhesive layer 70 can comprise a double-coated tape. For instance, adhesive layer 70 can comprise a first adhesive layer disposed on a first side or surface of a backing member and a second adhesive layer disposed on an opposing second side or surface of the backing member. The backing member can comprise a polyester film (e.g., polyethylene terephthalate or PET), thermoplastic polymer/resin, or other material suitable for receiving one or more adhesive layers on opposing sides or surfaces thereof. The adhesive disposed on the opposing sides of the backing member can comprise a synthetic rubber. One example of a double-coated tape is the LUDLOW TAPE M-Tak 7420L available from Berry Plastics.

Since the drugs used in blinded trials on occasion need to be shipped cold, it is desirable that the adhesive be operable (i.e., maintain its adhesive properties) at temperatures ranging from at least below −40° C., −60° C. or −80° C., up to at least above 40° C., 60° C., 82° C. or higher, or any range of temperatures therebetween. For instance, certain drugs are typically maintained at about −80° C. during storage and/or use. Other drugs are typically stored, transported, and/or administered at higher temperatures (e.g., in remote villages in high temperature regions of the world). In some embodiments, the adhesive can be selected to be operable in a temperature range suitable for the drug to be disposed therein.

Adhesive layer 70 (or adhesive layers thereof) can have a length extending at least partially between opposing side edges 50*b* and 50*d* and can have a variety of suitable dimensions and/or sizes. For instance, adhesive layer 70 can have a thickness (up from inner surface 66 of attachment portion 64) of up to, at least, or about 0.1 mm, 0.2 mm, 0.25 mm, 0.5 mm, 1 mm, 1.5 mm, 2 mm, 2.5 mm, and/or 5 mm or between any of the foregoing. Thicknesses less than 0.1 mm or greater than 5 mm are also contemplated herein. Adhesive layer 70 (or adhesive layers thereof) can also have a width of up to, at least, or about 2 mm, 5 mm, 10 mm and/or 20 mm or between any of the foregoing. Widths less than 2 mm or greater than 20 mm are also contemplated herein.

A removable liner 74 can be disposed over at least a portion of adhesive layer 70. For instance, removable liner 74 can comprise a polymeric sheet or strip covering at least a portion of adhesive layer 70. In at least one embodiment, removable liner 74 completely covers adhesive layer 70 such that adhesive layer 70 is not exposed on inner surface 66 of attachment portion 64 of outer top closure panel 50.

Removable liner 74 can also have at least one lifting edge 68 at an end thereof. In at least one embodiment, lifting edge 68 can be easily accessible to fingertips for gripping and removing removable liner 74. Moreover, removable liner 74 can have printing 76 disposed thereon. For instance, printing 76 can comprise writing printed on a surface of removable liner 74 and/or indicating an expiration date for adhesive layer 70 and/or instructions for exposing the adhesive layer.

As previously mentioned, floor 23 need not be an automatic folding floor but could have other configurations. For example, floor 23 could have the same configuration as covering 29 discussed above or could be the same as covering 29 except not include zipper tear strip 60 on outer top closure panel 50. In still other embodiments, floor 23 could comprise dust flaps 40 and inner top closure panel 30 with tuck flap 32. In yet other embodiments, floor 23 can comprise 3 or 4 separate panels that fold over and are held together by an adhesive such as a glue, tape, or sticker.

Illustrative Methods of Assembling and Using Zipper Carton Assemblies

Illustrative methods of using zipper carton assembly 10 will now be described. It will be appreciated, however, that zipper carton assembly 10 can have a variety of alternative uses, which will be apparent to those skilled in the art or through practice of the present disclosure.

Initially, zipper carton assembly 10 is typically manufactured into the flat, collapsed configuration depicted in FIG. 6 at a manufacturing facility. This is typically accomplished by forming template 18 of carton body 12 as depicted in FIG. 2. Template 18 is usually formed by using conventional cutting techniques to cut template 18 from a single, unitary continuous sheet of material, such as those previously discussed. In alternative embodiments, template 18 could comprise two or more separate parts that are connected together such as through adhesive, tape or fasteners. The cutting process includes the formation of zipper tear strip 60. Once template 18 is formed, adhesive layer 70 is secured to attachment portion 64 of outer top closure panel 50. Removable liner 74 is typically previously attached to adhesive layer 70 before securing to outer top closure panel 50, but could be attached after the placement of adhesive layer 70. In another alternative embodiment, it is appreciated that adhesive layer 70 and removable liner 74 can be attached to the sheet of material before template 18 is cut therefrom or could be placed at a stage during the cutting process.

Once template 18 is formed, template 18 is folded and attachment flap 88 is secured to the interior surface of side wall panel 82, thereby forming encircling side wall 14. As depicted in FIG. 3, attachment flap 88 can be secured to the inner surface of side wall panel 82 through the use of an adhesive. Again, to enable cold shipping of the zipper carton assemblies 10, in one embodiment it is desirable that all adhesives used on carton assemblies 10 be operable at temperatures at least below −40° C., −60° C. −80° C., up to at least above 40° C., 60° C., 82° C., or higher, or any range of temperatures therebetween. Those skilled in the art will appreciate that attachment flap 88 can alternatively be secured to the outer surface of side wall panel 82. Likewise the process could be reversed by having attachment flap 88 formed on side panel 82 and then attached to rear panel 86.

Floor 23 is assembled as previously discussed. Specifically, floor panel attachment flap 28 of each floor panel 25 is attached to the floor panel 26 (immediately) adjacent to the attachment flap 28 by an adhesive, thereby forming opposing sub-floors. The connected floor panels 25 and 26 are folded into compartment 16 of carton body 12 as depicted in FIGS. 3 and 4. In this assembled configuration, zipper carton assembly 10 can be placed in the flat collapsed configuration depicted in FIG. 6. At this stage, the collapsed zipper carton assemblies 10 are typically stacked and packaged with other collapsed zipper carton assemblies 10 and then shipped to a separate facility where they are manipulated to the erected configuration as depicted in FIGS. 1 and 5 and then loaded with the blinded trial product.

Those skilled in the art will appreciate that zipper carton assembly 10 can be assembled in any suitable order. For instance, opposing sides of encircling side wall 14 can be connected before or after assembly of floor 23 without necessarily departing from the scope of this disclosure. In addition, zipper carton assembly 10 can be at least partially assembled by machine. For instance, foldable sheet 18 can be inserted into a carton assembly machine (not shown) adapted for securing attachment flap 88 to side wall panel 82 and/or assembling floor 23 as described above. Those skilled in the art will also appreciate that other floor configurations are also contemplated herein, including overlapping, stacked floors, unitary floors, and so forth.

Figure 7:
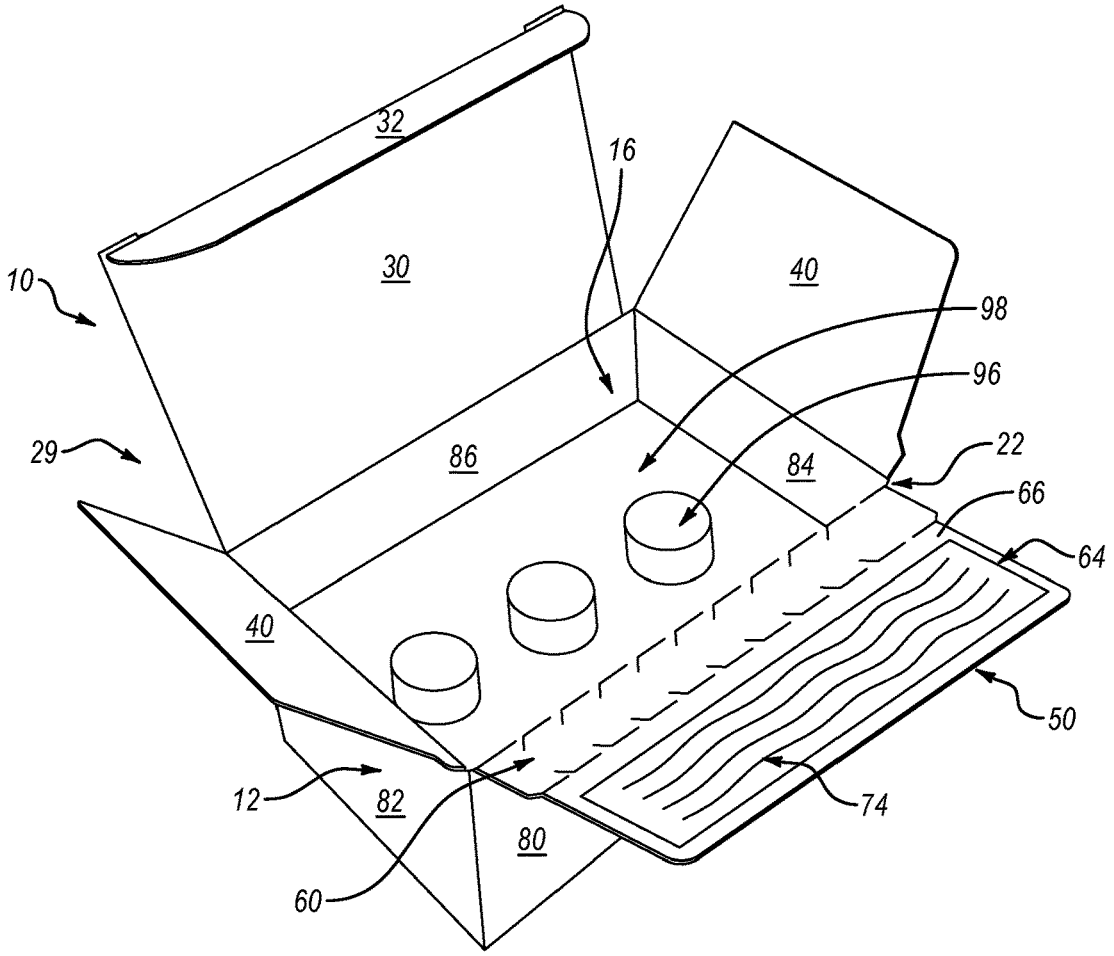
FIG. 7 is a top perspective view of the zipper carton assembly of FIG. 1 having a product disposed therein.

FIGS. 7 through 13 illustrate one method of how collapsed zipper carton assemblies 10 obtained from a manufacture can be used for loading, delivering and dispensing blinded trial products. Once the collapsed zipper carton assemblies 10 are obtained they can be manipulated to the erected position as discussed above and depicted in FIGS. 1 and 5. While in the erected position, a blinded trial product 96 can be placed within inner compartment 16 of zipper carton assembly 10, as illustrated in FIG. 7. In at least one embodiment, blinded trial product 96 can comprise one or more different products (e.g., CTM). For example, blinded trial product 96 can comprise a test product which can comprise an active drug product, a comparative product, a control product, a placebo product, or one or more combinations of the foregoing. Furthermore, in different zipper carton assemblies or in the same zipper carton assembly, the active drug product, comparative product, control product, and/or placebo product can be provided in different quantities, volumes, concentrations, strengths, types (i.e., pill, ointment, liquid, injection, etc.) or combinations of the foregoing. Furthermore, in at least one embodiment, blinded trial product 96 can include multiple dosages or concentrations of one or more different blinded trial products 96. Accordingly, blinded trial product 96 can comprise a plurality of different containers and different container types being placed in the same or different zipper carton assemblies. Depending on the form of the drug being tested, the foregoing products may be housed in pill bottles, syringes, vials, tubes or other conventional containers.

Blinded trial product 96 can also comprise one or more support products such as antiseptics, band aids, swabs, gauze, tape, instructions, disposal containers or any other accessories that may be used or associated with the drug being tested. The bind trial product 96 can be held securely within compartment 16 by way of packaging 98. In some embodiments, "blinded trial products" (or similar terms) can include any clinical trial material (CTM) and does not need to be limited to blinded materials or materials used in blinded trials or studies or components used therein.

Once blinded trial product 96 has been properly packed within zipper carton assembly 10, zipper carton assembly 10 can then be moved from the erected, opened position illustrated in FIG. 7 to an erected, closed position illustrated in FIG. 9. This is accomplished by folding optional dust flaps 40 inward so as to extend over compartment 16 and folding inner top closure panel 30 inward in like manner as depicted in FIG. 8. Tuck flap 32 projecting from inner top closure panel 30 is advanced into compartment 16 so that a portion of side edges 36 of tuck flap 32 adjacent to notch 38 can be inserted beneath tuck flap engagement tab 44 of dust flap 40 and/or between engagement tab 44 and outer top closure panel 50 (or side wall 14). Inner top closure panel 30 can thereby be held tightly against folded dust flaps 40 in the closed position.

As illustrated in FIGS. 9 and 10, erected, closed zipper carton assembly 10 can then be sealed closed by removing (e.g., peeling away) removable liner 74 from adhesive 70 and folding outer top closure panel 50 against inner top closure panel 30 so that adhesive layer 70 bonds inner surface 66 of attachment portion 64 to outer surface 31 of the inner top closure panel 30. In so doing, zipper carton assembly 10/compartment 16 becomes sealed closed so that blinded trial product 96 cannot be accessed or tampered with until zipper carton assembly 10 is opened by the removal of zipper tear strip 60. Accordingly, in the sealed configuration illustrated in FIG. 10, the unsealed indicator 72 and/or opened padlock icon(s) 73 thereof are covered by outer top closure panel 50 and/or zipper tear strip 60 thereof. As illustrated in FIG. 10, removable zipper tear strip 60 is disposed on the upper surface of covering 29 when zipper carton assembly 10 is in the sealed position. As a result, the sealed indicator 77 and/or closed padlock icon(s) 78 thereof disposed on the outer or exterior surface of the zipper tear strip 60 are exposed and/or visible on the upper surface of covering 29 when zipper carton assembly 10 is in the sealed position.

In one embodiment of the present invention, score lines can be used to prevent or indicate improper opening or attempts to improperly open sealed zipper carton assembly 10. By way of example, as depicted in FIG. 9, a plurality of score lines 102 (i.e., 102*a*, 102*b*, 102*c*, 102*d*, 102*e*, and 102*f*) can be formed on outer surface 31 of inner top closure panel 30. Each score line 102 is typically cut or otherwise formed into outer surface 31 such as by using a press, knife, sharp edge, or other cutting structure, while carton body 12 is still flat in the manufacturing stage. In one embodiment, each score line 102 extends between 10% and 90% through inner top closure panel 30 between outer surface 31 and inner surface 33. More typically, each score lines 102 extends between 20% and 80% or between 30% and 70% through inner top closure panel 30. In other embodiments, score lines 102 can extend at least 20%, 30%, 40%, 50%, or 60% through inner top closure panel 30 but do not pass completely through inner top closure panel 30. In still other embodiments, score lines 102, or at least portions thereof, can pass entirely through top closure panel 30.

It is appreciated that any desired number of score lines 102 can be used. For example, 1, 2, 3, 5, 6, 7, 10 15, 20 or more score lines 102 can be used. Likewise, the number of score lines 102 can be at least or not to exceed any of the foregoing numbers of score lines 102 or can be in a range between any two of the foregoing number of score lines 102.

Figure 33:
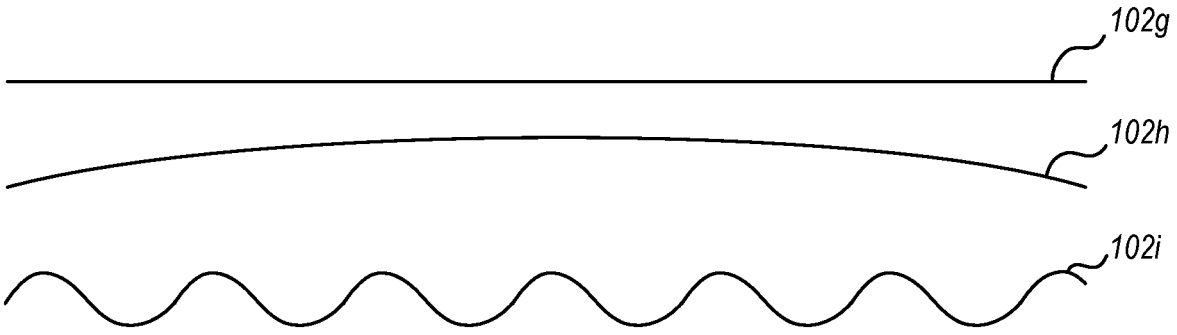
FIG. 33 is a top plan view of different designs for score lines.
Figure 34:
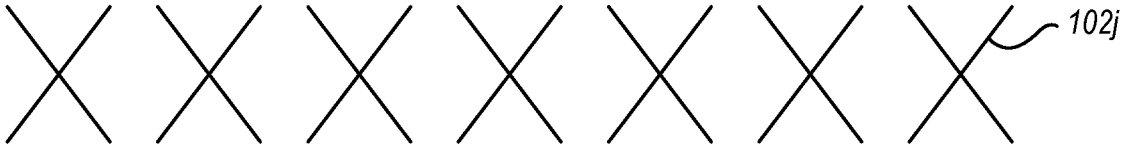
FIG. 34 is a top plan view of score lines having an X configuration.
Figure 35:
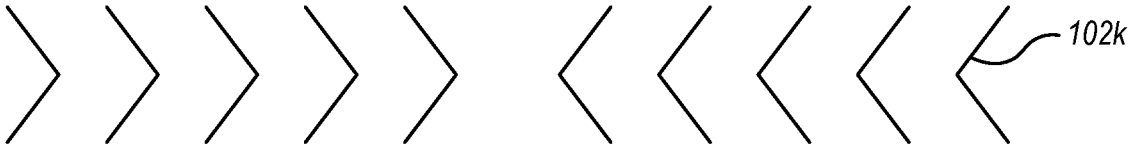
FIG. 35 is a top plan view of score lines having an arrow configuration.

It is also appreciated that score lines 102 can be formed in any desired configuration. For example, as depicted in FIG. 9, score lines 102 are formed in the shape of paired parentheses. As depicted in FIG. 33, score lines 102 can comprise one or more linear lines 102*g*, one or more curved lines 102*h*, one or more sinusoidal lines 102*i*, or combinations of the foregoing. The score lines can also be positioned in any desired orientation, i.e., vertically, horizontally or some other angle. As further examples, FIG. 34 shows score lines 102*j* that are in the form of X's while in FIG. 35 shows score lines 102*k* that are in the form of arrows (<, >). In other embodiments, other configuration and layouts of score lines can be used.

As depicted in FIGS. 9 and 10, score line 102 are formed on outer surface 31 of inner top closure panel 30 so that when attachment portion 64 of outer top closure panel 50 is secured to inner top closure panel 30 by adhesive layer 70, adhesive layer 70 at least partially overlays score lines 102. Score lines 102 weaken the integrity of the material used to form carton body 12. This is especially true where carton body 12 is formed from a paper material. Accordingly, if an attempt is made to open sealed zipper carton assembly 10 by upwardly prying outer top closure panel 50 so that adhesive layer 70 detaches from inner top closure panel 30, score lines 102 cause the material around score lines 102 to more easily tear. For example, an outer layer or an entire thickness of inner top closure panel 30 can tear off and remain attached to adhesive layer 70, thereby both deforming inner top closure panel 30 and preventing adhesive layer 70 from reattaching to inner top closure panel 30. In other embodiments, the material around score lines 102 may tear but not necessarily remain attached to adhesive layer 70. In this embodiment, the deformation and markings formed on inner top closure panel 30 produced by the tearing can prevent proper resealing of adhesive layer 70 and provide other visual indications of tampering with sealed zipper carton assembly 10. As discussed below in further detail, score lines 102 can also be used at other locations in association with zipper carton assembly 10 to prevent and/or identify tampering.

Either prior to, during, or after loading of the blinded trial product 96, one or more labels can be secured on the exterior or interior surface of carton body 12. The labels can provide instructions, identification indicia, or other relevant information for the blinded trial. Once zipper carton assembly 10 is sealed closed, it can be packaged with other zipper carton assemblies 10 for transporting as a group or can be individually transported to a first recipient (e.g., medical practitioner such as an administering technician). The technician can then administer the blinded trial product 96 (e.g., by opening zipper carton assemblies 10, removing blinded trial product 96, and so forth) or deliver the zipper carton assemblies 10 to a second recipient for administration of the blinded trial product 96.

In certain embodiments, filled, closed, and sealed zipper carton assembly 10 (e.g., a blinded kit carton) can be distributed to a hospital or clinic where they can be distributed to patients either directly on site or for the patient to take home for self-administration. It will also be noted that steps of erecting zipper carton assembly 10, inserting blinded trial product 96 therein, closing zipper carton assembly 10, sealing zipper carton assembly 10, and labeling zipper carton assembly 10 can be accomplished by up to five separate people. In at least one embodiment, however, a plurality of said steps is performed by the same person. For instance, in at least one embodiment, each of the foregoing steps is performed by the same person.

Figure 12:
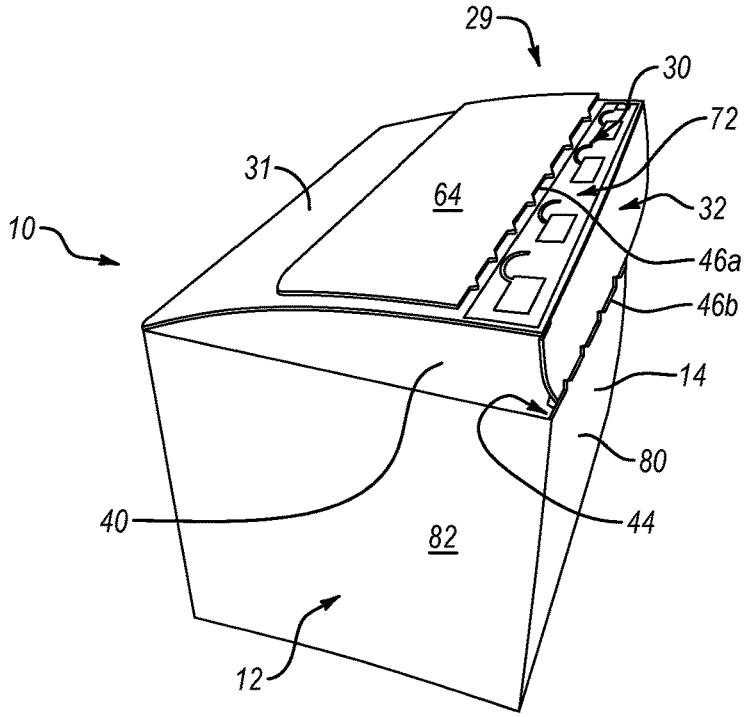
FIG. 12 is a top perspective view of the zipper carton assembly of FIG. 10 in an unzipped and partially opened configuration.

The sealed zipper carton assembly 10 is typically opened by a recipient, such as the administering technician of the medical practice participating in the trial or the patient receiving the dosage thereof. As illustrated in FIGS. 10, 11, and 12, sealed zipper carton assembly 10 can be opened by removing the zipper tear strip 60 from the upper surface of covering 29. For instance, a lifting tab 68 of removable zipper tear strip 60 can be (easily) pulled away from attachment portion 64 of outer top closure panel 50. By pulling on lifting tab 68, zipper tear strip 60 is pulled away from attachment portion through the assistance of perforations 62. Upon complete removal of the zipper tear strip 60, as depicted in FIG. 12, attachment portion 64 is still secured to upper surface 31 of inner top closure panel 30. A jagged edge 46*a* on attachment portion 64 can indicate removal of zipper tear strip 60. Similarly, the upper edge of the front panel 80 from which zipper tear strip 60 was removed can also have a jagged edge 46*b*.

The removal of removable zipper tear strip 60 can also remove the sealed indicator 77 and/or closed padlock icon(s) 78 thereof disposed on the outer or exterior surface of the zipper tear strip 60, thereby exposing the unsealed indicator 72 and/or opened padlock icon(s) 73 thereof disposed on the upper surface 31 of inner top closure panel 30. Accordingly, embodiments of the present disclosure provide a clear, visual distinction between the zipper carton assembly 10 in the sealed configuration (see FIG. 10) and in the unsealed configuration (see FIGS. 11 and 12) by implementing visual indicators of the sealed and unsealed configurations.

Figure 13:
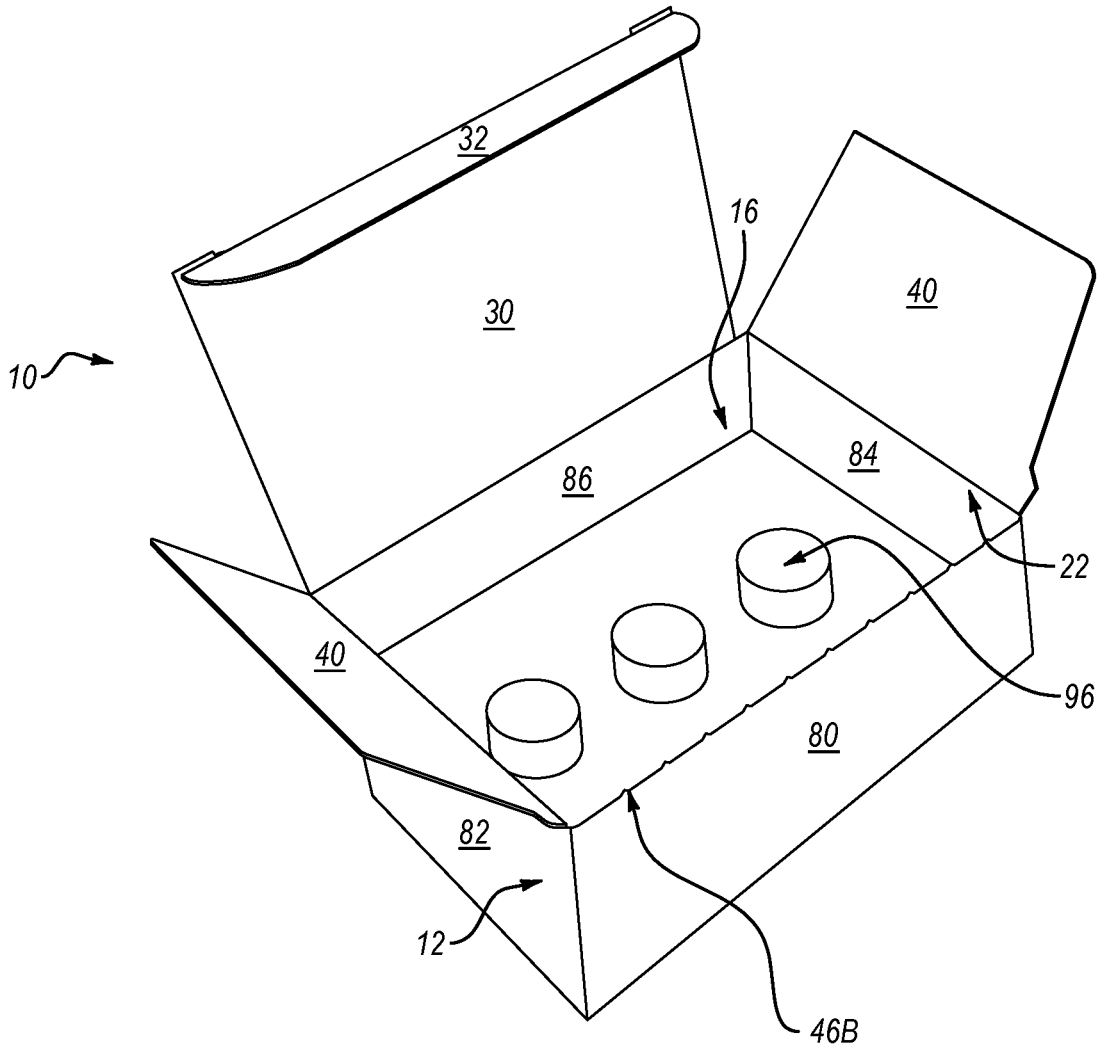
FIG. 13 is a top perspective view of the zipper carton assembly of FIG. 10 in an unzipped and opened configuration.

As illustrated in FIGS. 12 and 13, once zipper tear strip 60 is removed, inner top closure panel 30 can be raised to so as to permit access to blinded trial products 96 within compartment 16. Specifically, tuck flap 32 of inner top closure panel 30 can be removed from its secured position within compartment 16 and then inner top closure panel 30 can be folded back. Optional dust flaps 40 can also be opened to more easily access and remove blinded trial product 96 from compartment 16.

It will be appreciated that zipper carton assembly 10 or carton body 12 thereof can be reclosed by reversing the foregoing steps involving dust flaps 40, inner top closure panel 30, and tuck flap 32. However, because zipper tear strip 60 has been removed such that attachment portion 64 remains secured to upper surface 31 of inner top closure panel 30, zipper carton assembly 10 or carton body 12 thereof cannot be resealed as before. Alternative resealing mechanisms can be employed to re-secure zipper carton assembly 10 or carton body 12 thereof. For instance, a sealing sticker can be attached to inner top closure panel 30 and to encircling side wall 14 in some embodiments.

Figure 14:
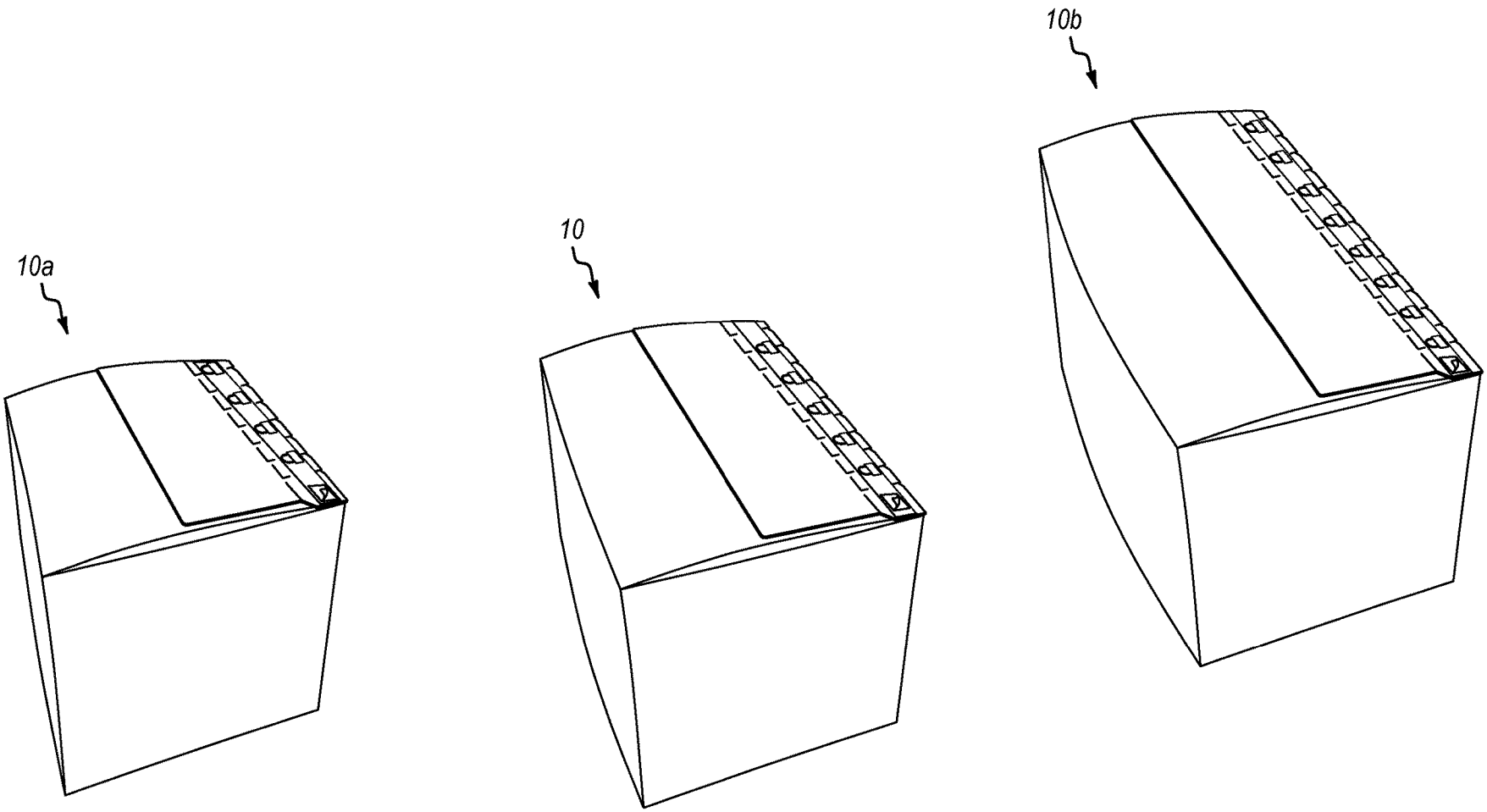
FIG. 14 is a top perspective view of zipper carton assemblies of varying sizes according to embodiments of the present disclosure.

FIG. 14 depicts a variety of exemplary zipper carton assemblies of different sizes, each of which may be suitable for certain embodiments of the present disclosure. For instance, in addition to zipper carton assembly 10 (having a rectangular cross-section as described above), FIG. 14 also depicts a zipper carton assembly 10*a* (having a substantially square-shaped cross-section) and a zipper carton assembly 10*b* (having an elongated rectangular cross-section). Those skilled in the art will appreciate that zipper carton assemblies 10*a* and 10*b* can be configured substantially similar to zipper carton assembly 10 and that zipper carton assemblies 10, 10*a*, and 10*b* (and/or respective compartments 16 thereof) can each have a different (interior) volume and/or different (outer and/or inner) dimensions. In other embodiments, it is appreciated that zipper carton assemblies can have other configurations and sizes.

Figure 15:
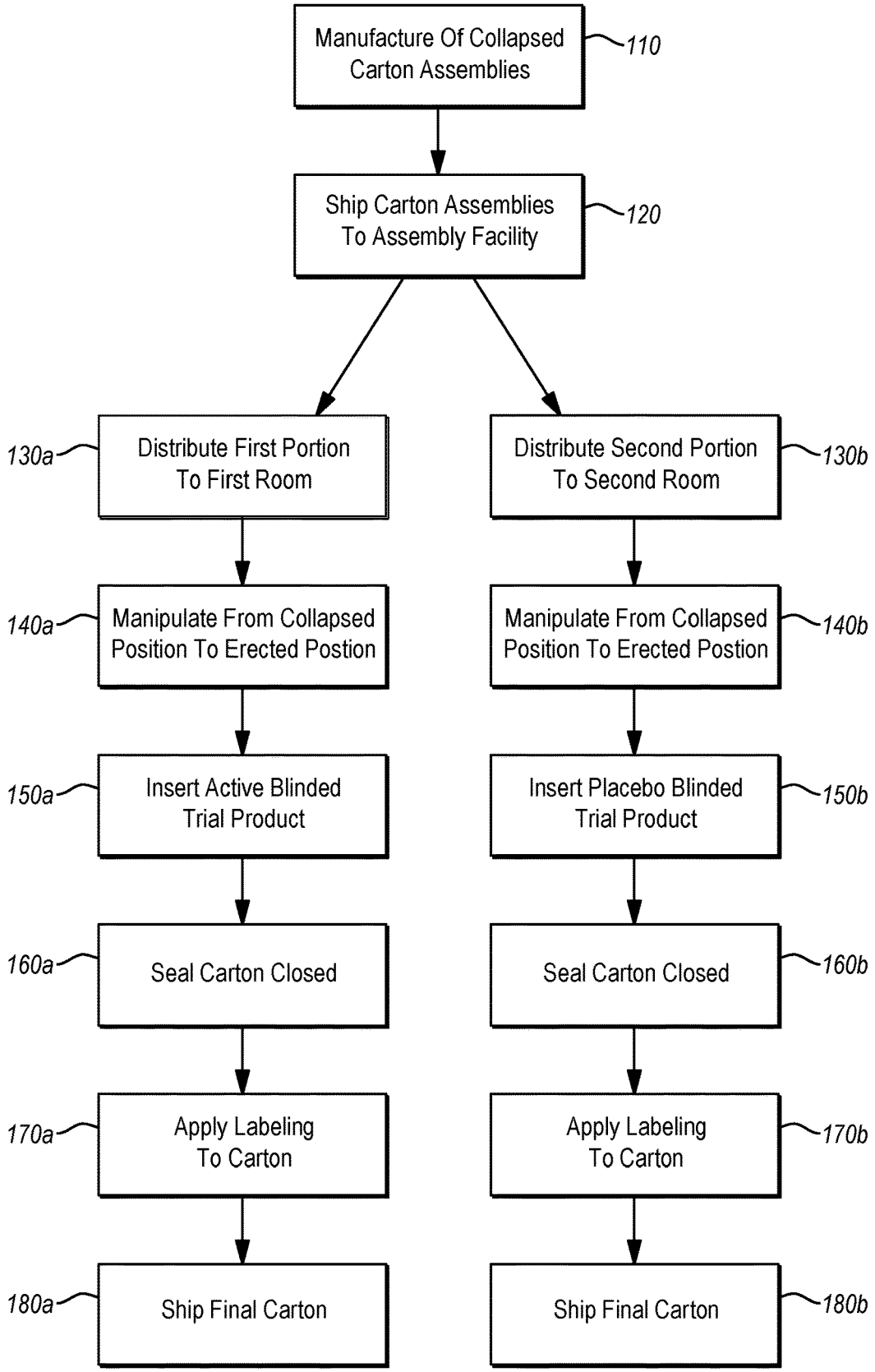
FIG. 15 is a flowchart illustrating a method of using the zipper carton assemblies according to an embodiment of the present disclosure.

FIG. 15 shows a flowchart depicting one method of conducting a blinded trial according to certain embodiments of the present disclosure. The method can include a step 110 of manufacturing a plurality of zipper carton assemblies at a manufacturing facility, as described above, and a step 120 of transporting (e.g., shipping, carrying, etc.) a plurality of the zipper carton assemblies to a separate blinded trial kit assembly facility. In at least one embodiment, the manufactured and/or transported zipper carton assemblies can be disposed in the collapsed configuration described above and illustrated by FIG. 6 for ease in shipping and/or handling.

The plurality of collapsed zipper carton assemblies can then be divided such that a first portion of the plurality of zipper carton assemblies is distributed to a first room of the assembly facility (step 130*a*) and a second portion of the plurality of zipper carton assemblies is distributed to a second room of the assembly facility (step 130*b*) that is separate from the first room. In some embodiments, the method and/or blinded trial protocol may require separate rooms (e.g., separated by a wall, divider, or other means for separation) for assembling blinded trial kits with different blinded trial products disposed therein. For instance, in at least one embodiment, the blinded trial protocol requires, calls for, and/or outlines that an active drug product be isolated in a first room of a kit assembly facility, while a control, compare, and/or placebo product be isolated in a second room of a kit assembly facility away and/or remote from the first room. Such separation may ensure the integrity, fidelity, and/or accuracy of the blinded trial by maintaining separate kit assembly rooms to guard against product confusion and/or mix-up. In other embodiments, it is appreciated that three, four, or more separate rooms can be used for packaging different active drug products, comparative products, control products, placebo products, combinations of the foregoing or different doses or concentrations of the foregoing. That is, a separate room can be used for packaging each different test product or blinded trial product being packaged.

The method may also include steps 140*a* and 140*b* of manipulating the first portion and the second portion of the plurality of zipper carton assemblies (e.g., in the first kit assembly room and the second kit assembly room, respectively) from the collapsed position into the erected position as described above. In the first kit assembly room, a first active drug product is then inserted into the inner compartment of one or more of the first portion of the plurality of zipper carton assemblies (step 150*a*). Likewise, in the second kit assembly room, a placebo product is inserted into the inner compartment of one or more of the second portion of the plurality of zipper carton assemblies (step 150*b*). In either room, as desired, a control or compare product can also be packaged with the active drug product or the placebo product. Indeed, a variety of combinations are available for grouping CTM according to various protocols. Those skilled in the art will appreciate that instructions can also be included in the sealed zipper carton assemblies to ensure proper conducting of the clinical trial or other form of product administration. The instructions can comprise the protocol parameters, including dosage amounts, times, and frequencies, as well as which product to administer in the given dosage amounts, times, and frequencies.

Zipper carton assemblies having a blinded test product disposed therein can then be sealed closed (steps 160*a* and 160*b*) as described above (by removing the removable adhesive liner from the adhesive layer disposed on the inner surface of the outer top closure panel and folding the outer top closure panel (and/or attachment portion thereof) against the outer surface of the inner top closure panel such that the inner surface of the attachment portion becomes (permanently) bonded to a portion of the outer surface of the inner top closure panel). The method can then include steps 170*a* and 170*b* of applying a label and/or labeling to each of the sealed zipper carton assemblies (e.g., in the first and second rooms, respectively). In steps 180*a* and 180*b*, the sealed and labeled (final) cartons (i.e., blinded trial kits) can then be transported (e.g., shipped, carried, etc.) from the respective first and second rooms to a third room in the kit assembly facility and/or from the kit assembly facility to a remote location for delivery to an administering technician or recipient.

It will be appreciated that steps taking place in the first room and second room, respectively, need not occur simultaneously. In addition, in at least one embodiment, the second room can be in a second facility. Accordingly, where controlled separation of the two portions of the plurality of zipper carton assemblies is desired, a variety of suitable separation strategies can be employed in various embodiments of the present disclosure. Embodiments of the present disclosure can also be implemented in a variety of alternative methods without departing from the scope of this disclosure.

It is appreciated that the inventive zipper carton assemblies and related methods of assembly and use have unique advantages over the prior art. For example, in one embodiment of the present invention the zipper carton assembly is sealed closed by removing removable liner 74 from adhesive layer 70 and then pressing outer top closure panel 50 against inner top closure panel 30 so as to adhere the two together. This assembly thus eliminates the need for any separate sealing sticker to seal the carton closed. Eliminating the sealing stickers eliminates the risk that different cartons could have stickers placed differently which could lead the recipient to infer that the blinded trial products within the cartons are different, and thereby partially defeat the purpose of a blinded trial. In contrast, because the outer top closure panel 50 for each carton assembly is identical and because they fully cover the adhesive layer 70 when moved to the closed position, all sealed zipper carton assemblies are identical in appearance with regard to the mechanism for sealing and thus there is no chance to infer differences between blinded trial products within the container. Furthermore, because of the integrated adhesive layer and the elimination of sealing stickers, it is simpler to seal the cartons closed and easier to provide instruction to those who are loading and sealing the cartons.

In addition, because of the use of the zipper tear strip to unseal the containers, the containers are easier to open and there is less risk of unintentional opening or rupturing during transport.

Furthermore, by using an automatic folding floor on the cartons, no separate adhesive or sealing sticker is required to be mounted on the floor when in the erected position which could likewise function to differentiate between different cartons. Other advantages also exist.

Alternative Zipper Carton Assemblies

Figure 16:
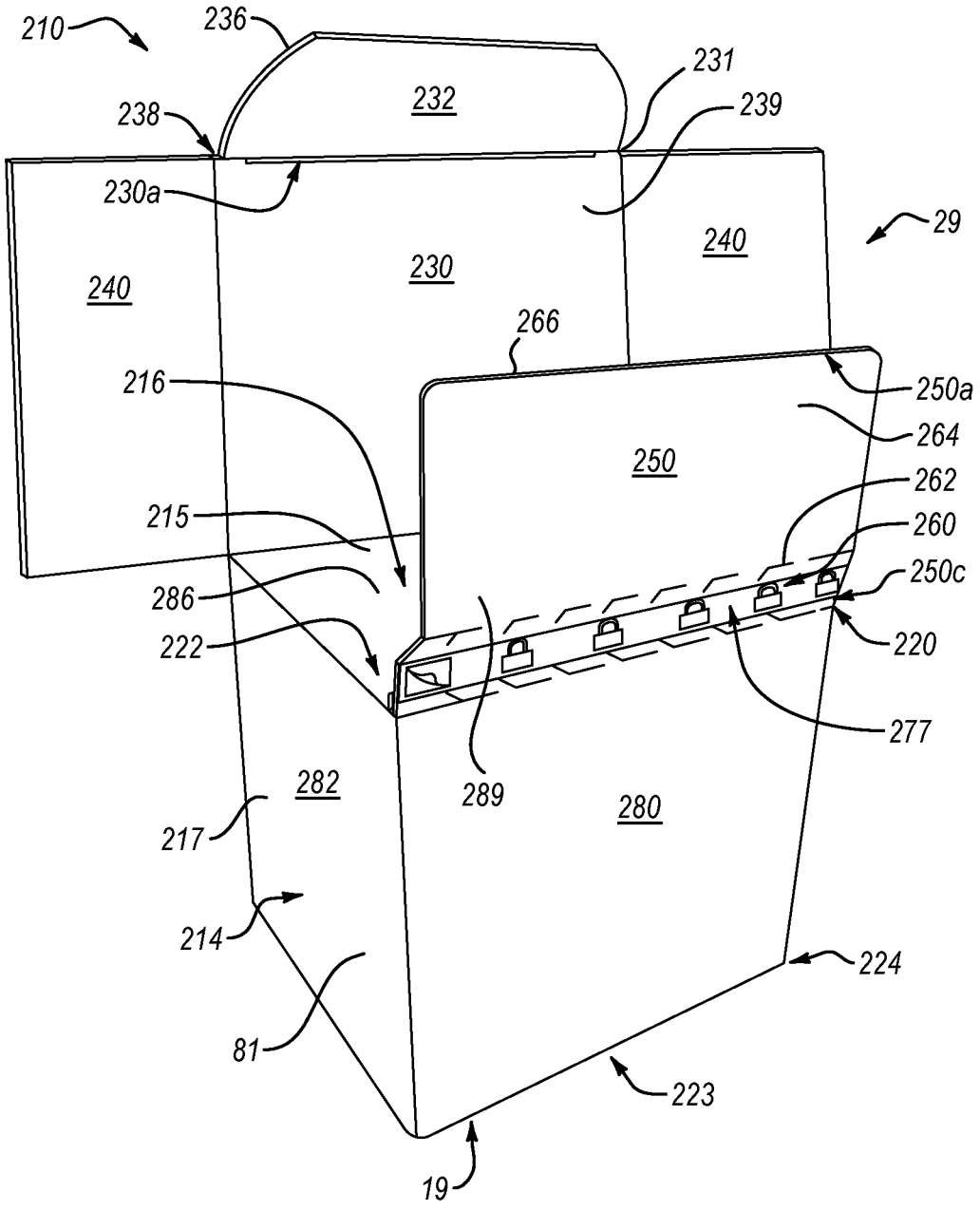
FIG. 16 is a front perspective view of another embodiment of a zipper carton assembly in an erected and opened configuration incorporating features of the present disclosure.
Figure 17:
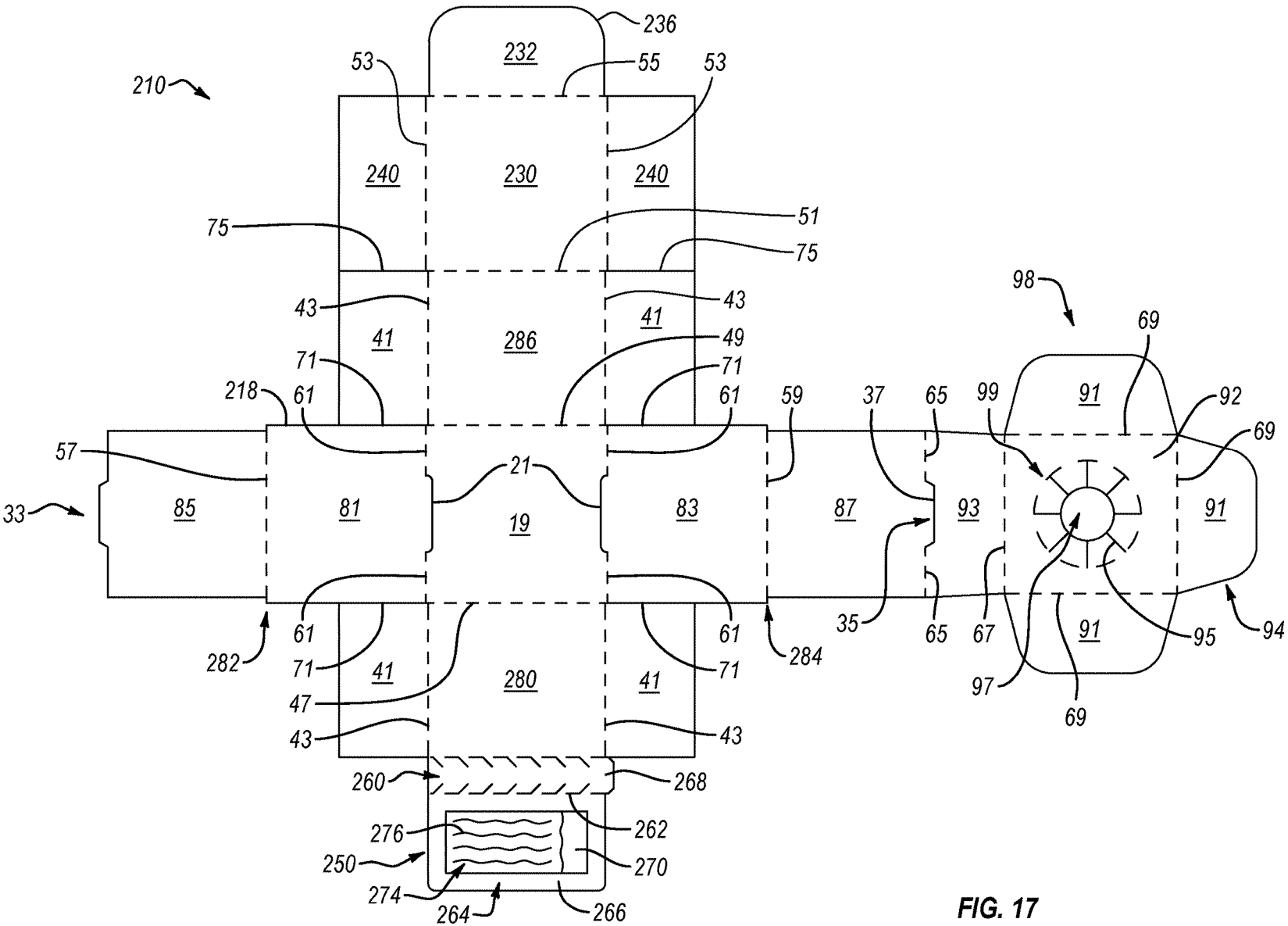
FIG. 17 is a top plan view of the zipper carton assembly shown in FIG. 16 in a flat, un-erected configuration.

Depicted in FIGS. 16 and 17 is an alternative embodiment of a zipper carton assembly 210 incorporating features of the present disclosure. Zipper carton assembly 210 can generally comprise components similar to those described in relation to zipper carton assembly 10 and like number references (preceded by a number 2) have been used to indicate like structure or structure that performs like function(s). However, zipper carton assembly 210 has various features that are different than those illustrated in zipper carton assembly 10. For instance, unlike zipper carton assembly 10, zipper carton assembly 210 has an encircling side wall 214 and a floor 223 that are formed from a different arrangement of panels. In particular, as illustrated in FIG. 17, floor 223 can comprise a single floor panel 19 disposed and connected between a front panel 280 and a rear panel 286, with a first crease 47 disposed between floor panel 19 and front panel 280, and a second crease 49 disposed between floor panel 19 and rear panel 286.

Floor panel 19 is also disposed and connected between opposing side panels 282 and 284. However, unlike side panels 82 and 84 of zipper carton assembly 10, side panels 282 and 284 each comprise an outer panel 81, 83 and an inner panel 85, 87 connected at upper end 220 of encircling side wall 214, with a crease 57, 59 disposed therebetween. Each inner panel 85, 87 includes a tab 33, 35 aligned with and/or insertable into a floor panel slit 21 disposed in floor panel 19 adjacent to creases 61. In some embodiments, crease 61 can comprise two creases 61 disposed on opposite sides of a slit 21.

Front panel 280 and rear panel 286 each have opposing flaps 41 extending laterally therefrom in opposite directions, with a crease 43 disposed between panel 280, 286 and flap 41. In the erected configuration illustrated in FIG. 16, flaps 41 are each disposed within folded side panels 282, 284 (i.e., between outer side panel 81, 83 and an inner panel 85, 87). A cut 71 separates and/or disconnects each flap 41 from an adjacent outer side panel 81, 83.

Returning to FIG. 17, similar to zipper carton assembly 10, an inner top closure panel 230 can extend from an upper edge of rear panel 286, with a crease 51 disposed therebetween. Unlike zipper carton assembly 10, however, dust flaps 240 extend laterally (outward) from inner top closure panel 230, in opposite directions, with a crease 53 disposed therebetween. Dust flaps 240 can extend laterally (outward) from inner top closure panel 230 a distance less than, similar to, equal to, or greater than adjacent flaps 41 extend from rear panel 286. A cut 75 separates and/or disconnects each dust flap 240 from adjacent flaps 41. Those skilled in the art will appreciate that inner top closure panel 30 of zipper carton assembly 10 (see FIGS. 1 and 2) can be arranged similar to inner top closure panel 230 in certain embodiments. Inner top closure panel 230 also has a tuck flap 232 extending therefrom with a crease 55 disposed therebetween. In at least one embodiment, however, unlike tuck flap 32 of zipper carton assembly 10 (see FIGS. 1 and 2), tuck flap 232 does not include slits (e.g., slits 38) extending along crease 55 for easy insertion into access opening 222 and/or compartment 216. It will be appreciated, however, that tuck flap 232 can include one or more slits in other embodiments.

An outer top closure panel 250 extends from the upper edge of front panel 280 and includes a zipper tear strip 260, an adhesive strip 270, and a removable liner 274.

Zipper carton assembly 210 also includes a packaging 98 incorporated into template 218. In particular, packaging 98 is connected to and/or extends from a bottom end of inner side panel 87, with a crease 65 disposed therebetween. In some embodiments, and as illustrated in FIG. 17, crease 65 comprises two creases 65 disposed on opposite sides of a slit 37 that forms tab 35. Packaging 98 includes a first support flap 93 connected to inner side panel 87 adjacent to crease 65 and/or slit 37. Thus, crease 65 and/or slit 37 can be disposed between first support flap 93 and inner side panel 87. Packaging 98 also includes a packaging panel 92 connected to first support flap 93 opposite inner side panel 87 with a crease 67 disposed between packaging panel 92 and first support flap 93.

Packaging panel 98 has a product receiving element 99 formed therein. Product receiving element 99 can have a variety of suitable configurations. For instance, product receiving element 99 can comprise a partially collapsible socket or opening 67 formed by a plurality of slits 95 disposed in packaging panel 92. It will be appreciated, however, that a variety of alternative product retaining mechanisms known to those skilled in the art are also contemplated herein. In addition, packaging 98 and/or packaging panel 92 thereof can include a plurality of product receiving elements 99 in certain embodiments.

As further depicted in FIG. 17, packaging 98 further comprises three additional support flaps 91 connected to packaging panel 92 adjacent and/or opposite first support flap 93, each with a crease 69 disposed between packaging panel 92 and the respective support flap 91. Support flap 91 can have a rounded outer edge 94 in some embodiments to allow for easy insertion into access opening 222 and/or compartment 216. Alternative embodiments can include one, two, four, or more additional support flaps 91.

It will be appreciated, therefore, that zipper carton assembly 210 can have one or more unique benefits and/or features. For instance, unlike zipper carton assembly 10, zipper carton assembly 210 does not necessarily require an adhesive material in order to manufacture, assemble, erect, form, manipulate, etc., zipper carton assembly 210 and/or zipper carton assembly template 218 into the zipper carton assembly 210. Instead, zipper carton assembly 210 can be self-supporting in a manufactured, assembled, erected, formed, manipulated, etc. configuration. It will be appreciated that zipper carton assembly 210 can still include an adhesive layer for sealing the zipper carton assembly upon being assembled, erected, formed, manipulated, etc. without negating the above-recited benefit and/or otherwise departing from the present disclosure.

Alternative Methods of Assembling and Using Zipper Carton Assemblies

Figure 18:
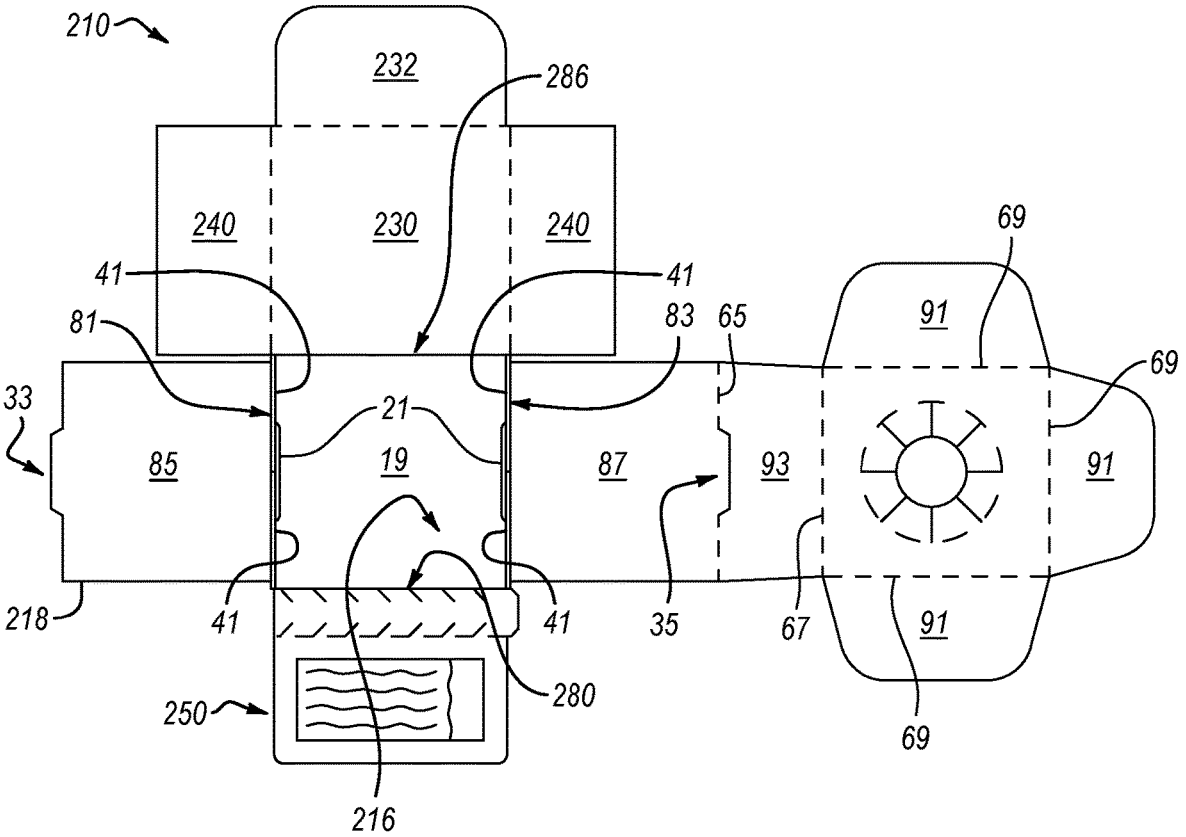
FIG. 18 is a top plan view of the zipper carton assembly of FIG. 16 in a partially erected configuration.

FIGS. 18 through 22 illustrate an exemplary method of erecting, assembling, and/or using zipper carton assembly 210. For instance, as illustrated in FIG. 18, with floor panel 19 forming a bottom, the sheet material of template 218 is folded at creases 47 and 49 (FIG. 17) such that front panel 280 and rear panel 286 are folded upward in a motion that begins to form compartment 216. The sheet material of template 218 is also folded at creases 43 such that each pair of opposing flaps 41 are folded inward toward compartment 216. The sheet material of template 218 is also folded at creases 61 such that outer side panels 81 and 83 are folded upward toward compartment 216 and/or against folded flaps 41.

Figure 19:
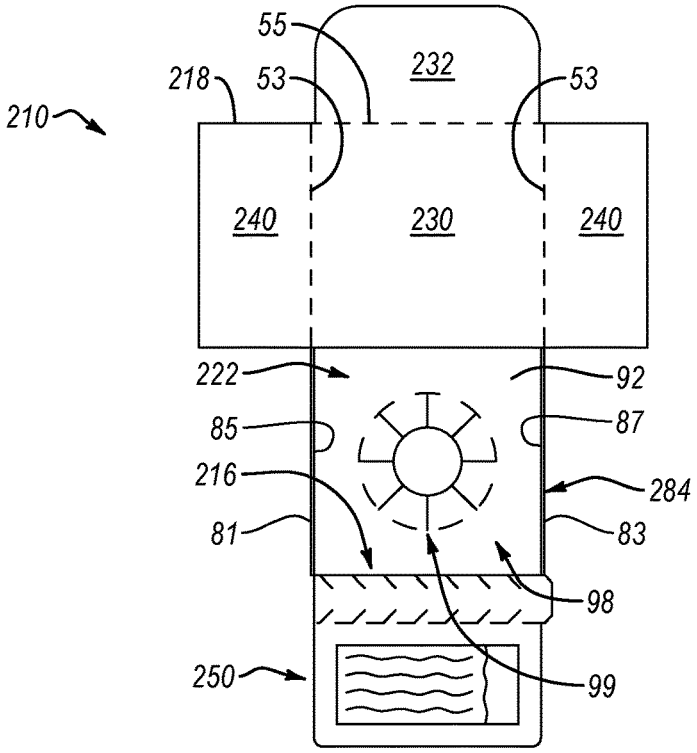
FIG. 19 is a top plan view of the zipper carton assembly of FIG. 16 in another erected and opened configuration.

As illustrated in FIG. 19, the sheet material of template 218 is then folded at crease 57 such that inner side panel 85 is folded downward, into compartment 216 and/or against folded flaps 41, forming a completed and/or erected first side wall 282. Accordingly, folded flaps 41 are disposed and/or sandwiched between outer side panels 81 and inner side panel 85 during assembly of zipper carton assembly 210. Side wall tab 33 is also inserted into first floor panel slit 21 disposed at the interface between floor panel 19 and outer side panel 81, thereby reversibly securing inner side panel 85 in a folded configuration that maintains first side panel 282 in an erected configuration.

Figure 20:
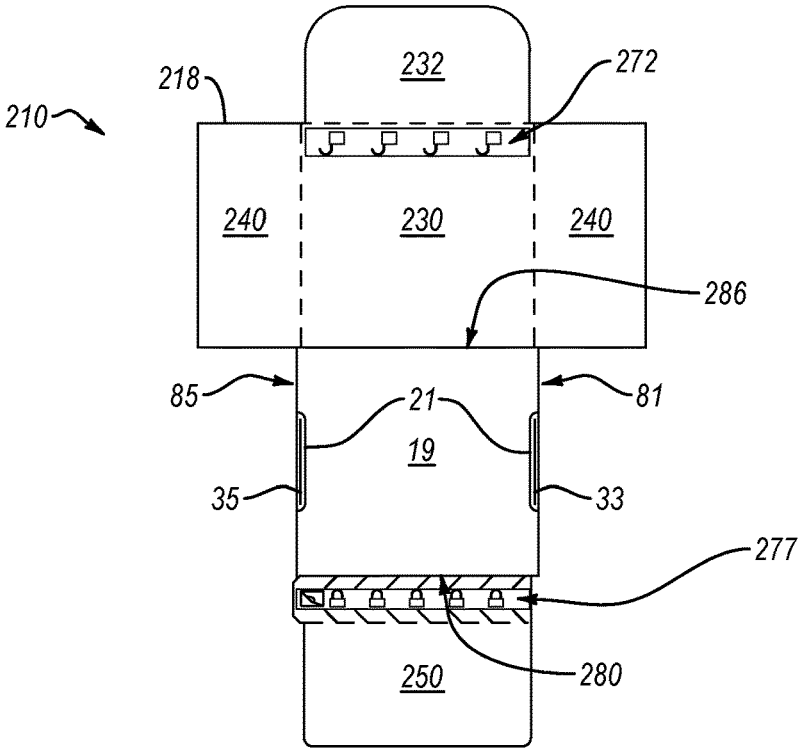
FIG. 20 is bottom plan view of the zipper carton assembly of FIG. 19.

The sheet material of template 218 is also folded at crease 59 such that inner side panel 87 is folded downward, into compartment 216 and/or against folded flaps 41, forming a completed and/or erected second side wall 284 in similar fashion. Side wall tab 35 is also inserted into second floor panel slit 21 disposed at the interface between floor panel 19 and outer side panel 83, thereby reversibly securing inner side panel 87 in a folded configuration that maintains second side panel 284 in an erected configuration. As depicted in FIG. 20, tabs 33 and 35 can protrude out of the bottom of zipper carton assembly 210, floor 223, and/or floor panel 19 thereof in the erected, reversibly secure configuration. Moreover, zipper carton assembly 210 can also include a sealed indicator 277 and an unsealed indicator 272, which can be configured, disposed, attached, and/or affixed as previously described in relation to sealed indicator 77 and unsealed indicator 72 (see FIGS. 1 and 9-12, and corresponding written description).

Returning to FIG. 19, the sheet material of template 218 is also folded at creases 65, 67, and 69 such that packaging 98 is properly erected and inserted into compartment 216, with support flaps 91, 93 extending upward from floor panel 19 such that packaging panel 92 is raised off of floor panel 19. Specifically, the sheet material of template 218 is folded at crease 65 such that first support flap 93 folds upward substantially against inner side panel 87. The sheet material of template 218 is also folded at crease 67 such that packaging panel 92 folds downward into compartment 216. Additional support flaps 91 are also folded into compartment 216 by folding the sheet material of template 218 at creases 69.

Figure 21:
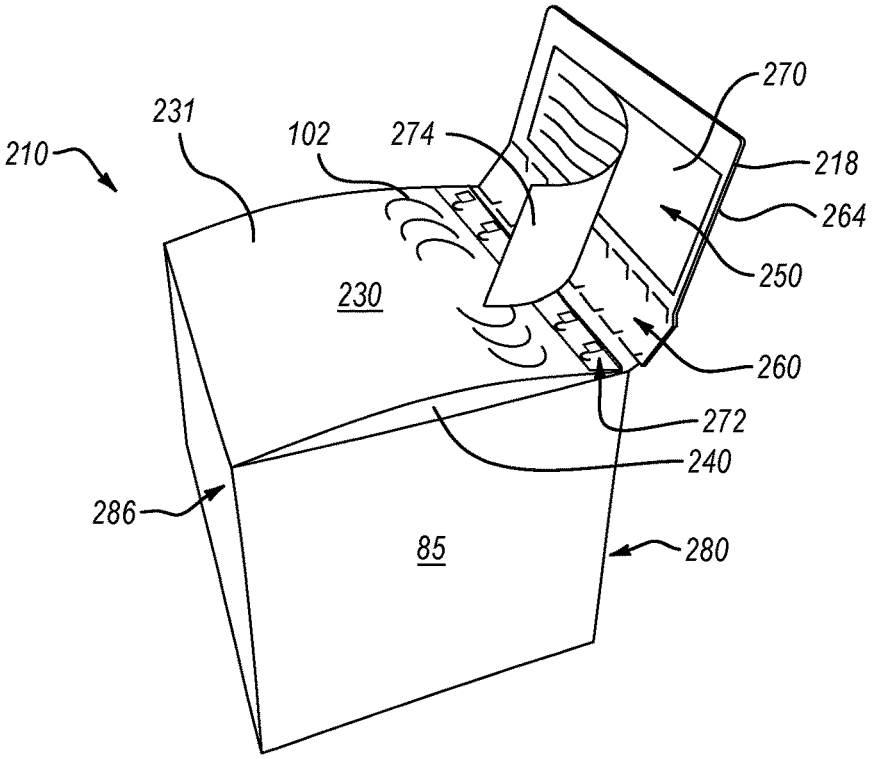
FIG. 21 is a top perspective view of the zipper carton assembly of FIG. 16 in a closed and unsealed configuration.

At least one blinded trial product 96 (see e.g., FIG. 7) can also be placed within inner compartment 216 of zipper carton assembly 210. For instance, while in the erected and opened configuration depicted in FIG. 19, blinded trial product 96 can be received by product receiving element 99. Zipper carton assembly 210 can then be closed, sealed, unsealed, and/or re-opened in a manner similar to zipper carton assembly 10 (see FIGS. 8 through 13) with variations as needed to accommodate the features of zipper carton assembly 210. In particular, as illustrated in FIG. 21, the sheet material of template 218 is folded at crease 51 such that inner top closure panel is folded so as to cover access opening 222, at creases 53 such that dust flaps 240 are disposed and/or inserted into compartment 216, and at crease 55 such that tuck flap 232 is disposed and/or inserted into compartment 216. So configured and/or folded, access opening 222 is substantially covered and/or concealed from view from one or more (e.g., every) vantage point.

Figure 22:
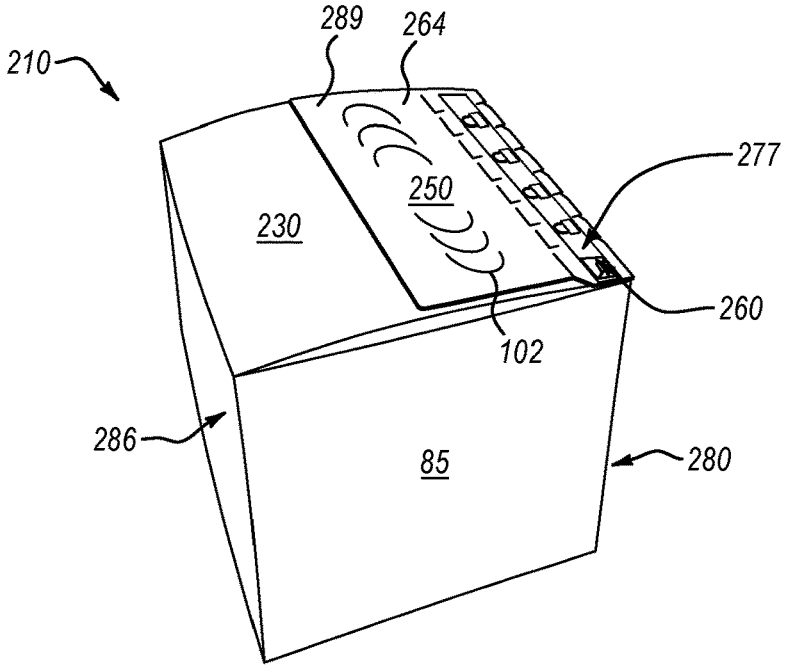
FIG. 22 is a top perspective view of the zipper carton assembly of FIG. 16 in a closed and sealed configuration.
Figure 23:
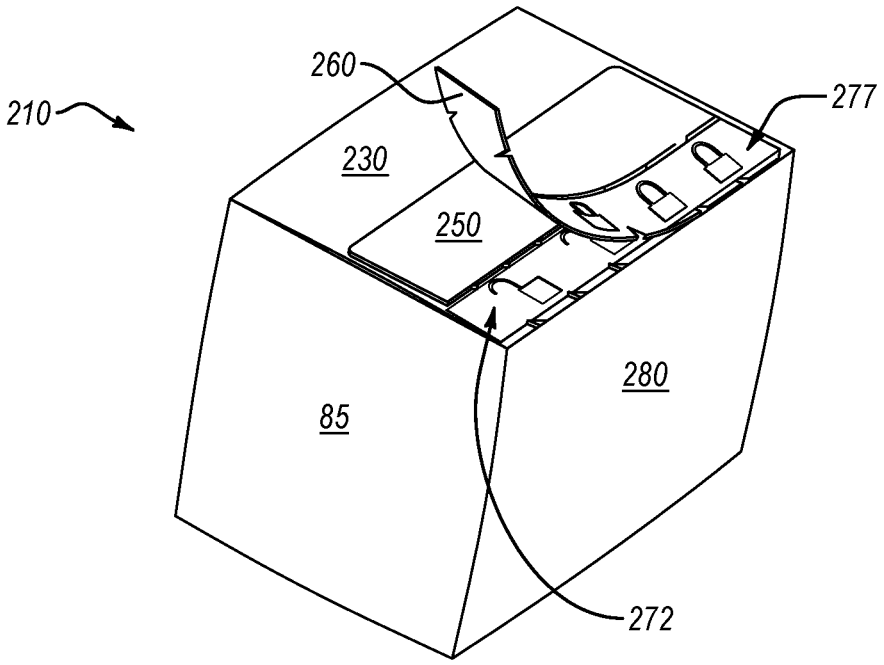
FIG. 23 is a top perspective view of the zipper carton assembly of FIG. 16 in a sealed and partially unzipped configuration.

Removable liner 274 can then be removed (e.g., peeled away), thereby exposing adhesive layer 270. As depicted in FIG. 22, after removing removable liner 274, the sheet material of template 218 is folded at zipper tear strip 260, adjacent to front panel 280, such that outer top closure panel 250 is folded over inner top closure panel 230 and secured thereto by means of (uncovered) adhesive layer 270. The visual indicator of unsealed configuration 272 can thereby be covered and the visual indicator of sealed configuration 277 can thereby be exposed and/or visible. As further depicted in FIG. 23, sealed zipper carton assembly 210 can be opened by pulling on lifting edge 268, for example, and removing zipper tear strip 260, as described previously in relation to zipper tear strip 60 (see FIGS. 11-13). The visual indicator of unsealed configuration 272 can thereby be exposed, as previously described.

As previously discussed with regard to zipper carton assembly 10, and as depicted in FIGS. 21 and 22, one or more scores lines 102 can also be formed on outer surface 231 of inner top closure panel 230 so that adhesive layer 270 at least partially covers score line 102 when adhesive layer 270 is secured to inner top closure panel 230. Again, score lines 102 are used to indicate improper opening or attempts to improperly open sealed zipper carton assembly 210. This is achieved by facilitating the tearing of a portion of inner top closure panel 230 if an attempt is made to open sealed zipper carton assembly 210 by prying up outer top closure panel 250 so that adhesive layer 70 detaches from inner top closure panel 230. The same numbers, configurations, layouts, uses, options and alternatives previously discussed with regard to score lines 102 and the use thereof on zipper carton assembly 10 are also applicable to using score lines 102 on zipper carton assembly 210.

Figure 24:
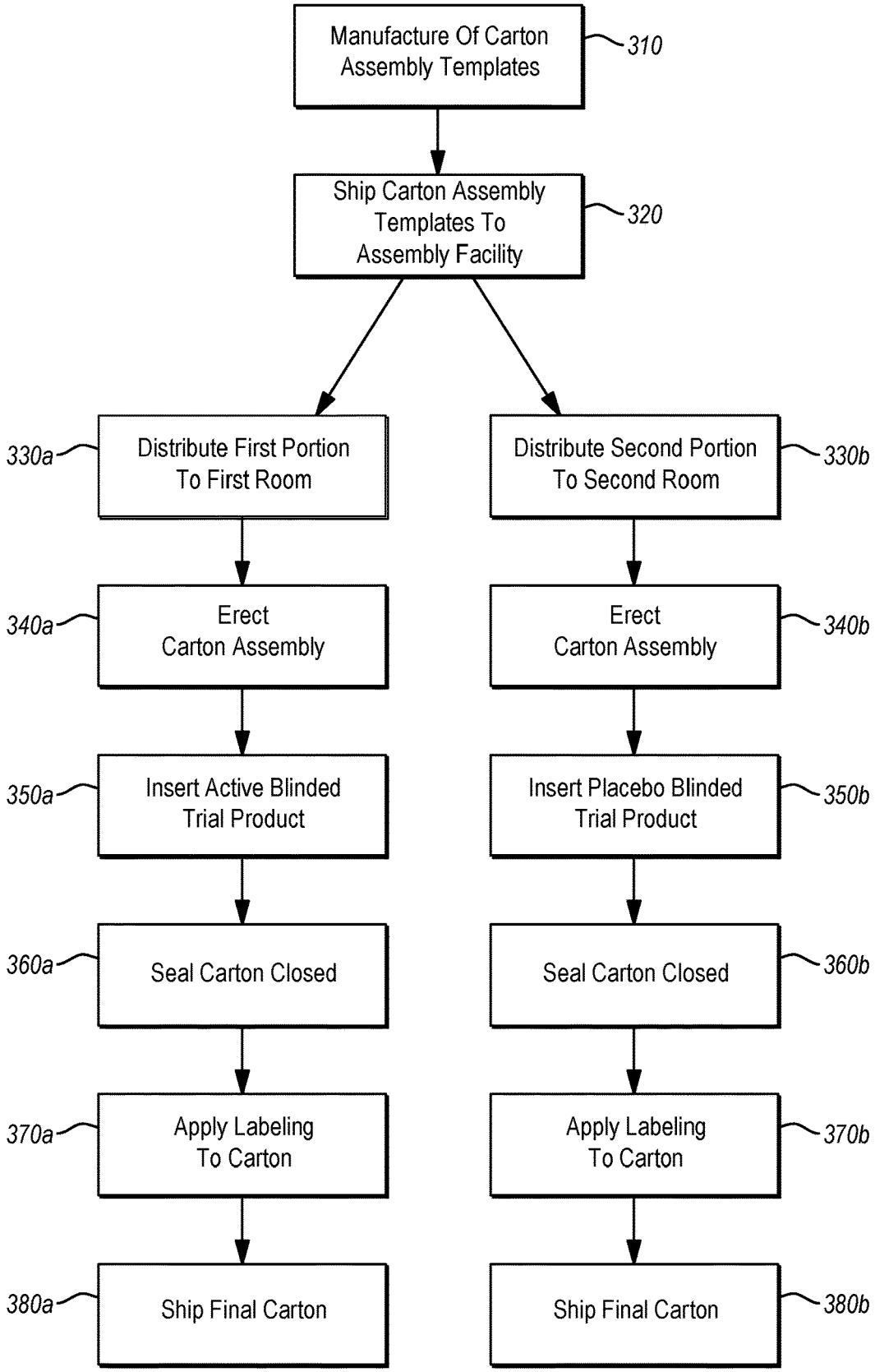
FIG. 24 is a flowchart illustrating a method of using the zipper carton assemblies according to another embodiment of the present disclosure.

FIG. 24 shows a flowchart depicting one method of conducting a blinded trial according to certain embodiments of the present disclosure. The method can include steps similar to the steps outlined in FIG. 15, but with variations as needed to accommodate the alternative embodiment. For instance, a step 310 includes manufacturing of carton assembly templates and step 320 includes shipping the manufactured templates to an assembly facility. At step 330*a*, 330*b*, first and second portions are again distributed into separate rooms. The carton assembly is erected at steps 340*a*, 340*b* within the separate rooms. It will be appreciated, however, that carton assemblies can be erected prior to being distributed into separate rooms in certain embodiments. The remainder of the method can then be performed as previously described.

Some embodiments described herein include products and methods related to comparing an active drug to a placebo in a blinded trial study. It will be appreciated that other applicable products and methods of use are also contemplated herein. For instance, certain embodiments can relate to comparing a first dosage amount or concentration of an active drug to a second dosage amount or concentration of the same active drug, and optionally, to a third dosage amount or concentration of the same active drug, and so forth. Accordingly, zipper carton assemblies can each receive one or more dosages or concentrations of a single active drug in certain embodiments.

In addition, some embodiments can relate to comparing a first drug to a second drug. For instance, one or more dosages or concentrations of a first drug can be compared to one or more dosages or concentrations of a second drug. Accordingly, zipper carton assemblies can each receive one or more dosages or concentrations of a plurality drugs (e.g., respectively) in certain embodiments. In at least one embodiment, the second drug can comprise a product already cleared for commercial distribution (e.g., FDA approved).

The foregoing comparisons can each optionally include at least one placebo in certain embodiments (e.g., in blinded (clinical) trial). Embodiments of the present disclosure can also be used in a variety of non-blinded trial-related processes. Indeed, embodiments of the present disclosure can be used as sealable, zipper cartons for any suitable use without necessarily departing from the scope of this disclosure.

Attachable Replacement Panel Assemblies

Figure 25A:
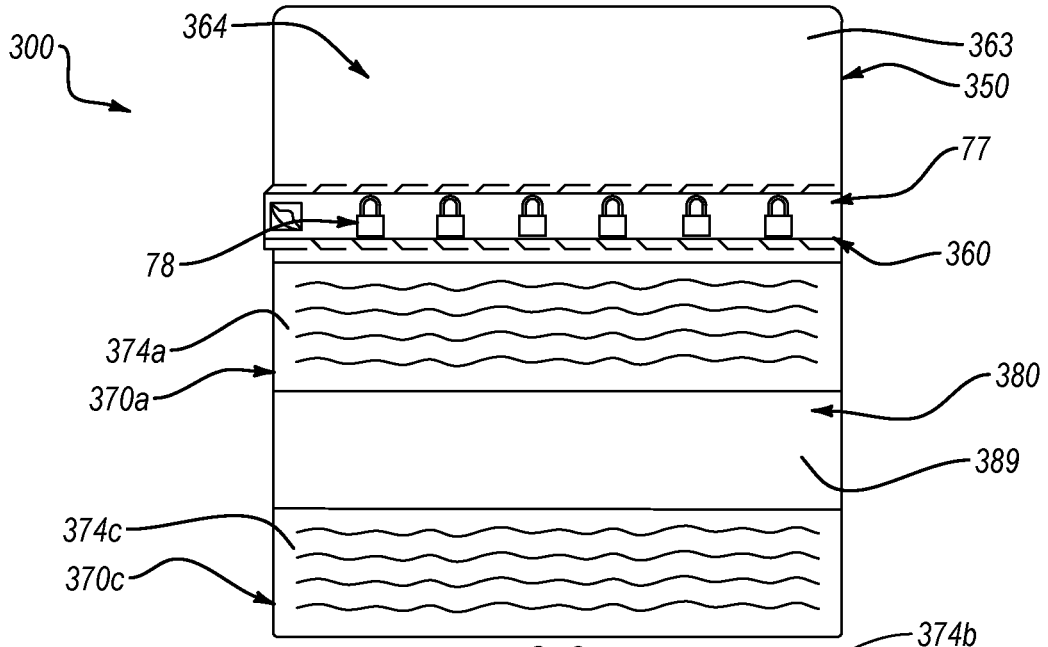
FIGS. 25A and 25B are front and back facing views of an attachable replacement panel assembly according to an embodiment of the present disclosure.
Figure 25B:
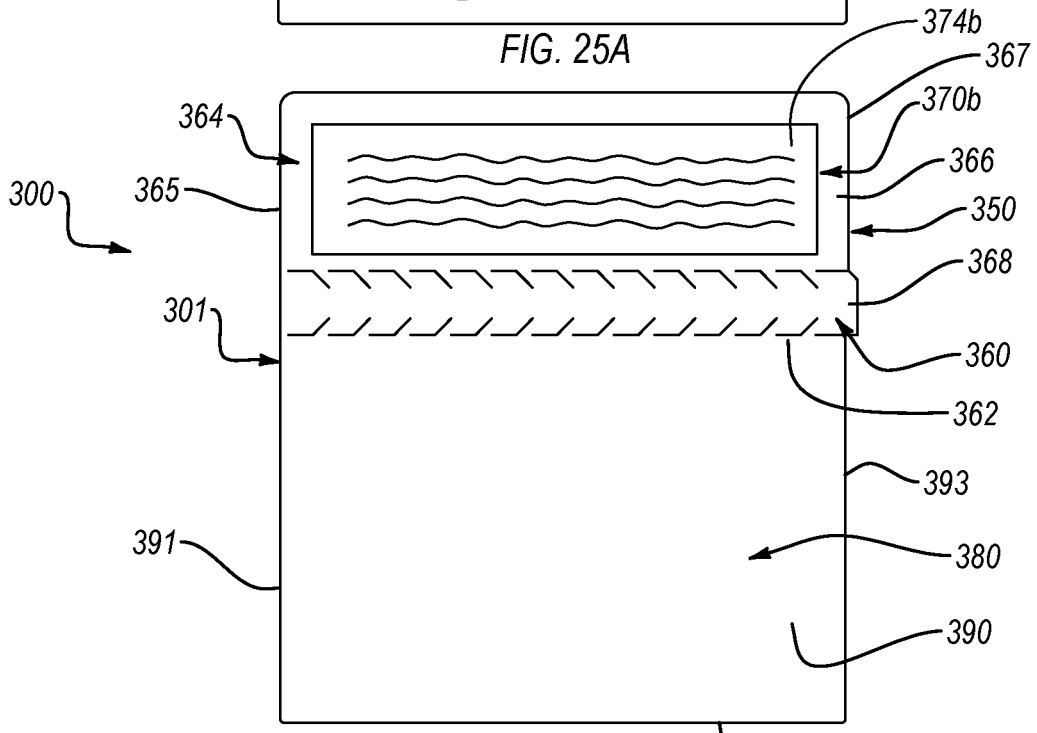

Depicted in FIGS. 25A and 25B is one embodiment of a replacement panel assembly 300 incorporating features of the present invention. Replacement panel assembly 300 can be used with zipper carton assembly 10 or 210 or other zipper carton assemblies to reseal the carton assemblies after the carton assemblies have been opened by the removal of zipper tear strips 60, 260 or the like. In addition, replacement panel assembly 300 can be used to initially seal and then subsequently reseal, if desired, carton assembles that are not initially formed containing an outer top closure panel 50, 250 or the like for use in sealing, and thus cannot initially be sealed closed without the use of a separate sticker or other sealing structure.

Replacement panel assembly 300 comprises a replacement panel 301 that is in the form of a flat sheet having a substantially square or rectangular configuration. As discussed later below, however, replacement panel 301 can have other configurations. Replacement panel 301 includes a mounting panel 380 and a replacement closure panel 350 that projects from mounting panel 380. Mounting panel 380 has a first side 389 and an opposing second side 390 that extend between opposing side edges 391 and 393. In this embodiment, at least a portion of side edges 391 and 393 are disposed in parallel alignment. Mounting panel 380 also has a bottom edge 395 of which at least a portion thereof can be perpendicular to side edge 391 and/or side edge 393. Replacement closure panel 350 comprises an attachment portion 364 and a removable zipper tear strip 360 disposed between the attachment portion 364 and the mounting panel 380. Attachment portion 364 has a first side 363 and an opposing second side 366 that extend between opposing side edges 365 and 367. Again, in this embodiment, at least a portion of side edges 365 and 367 are disposed in parallel alignment.

Zipper tear strip 360 can be configured substantially similar or identical to zipper tear strips 60 and 260, previously discussed, including, for example, having or being formed by two spaced apart rows of perforations 362 that pass at least partially through the replacement closure panel 350 and having a lifting tab 368. As such, all prior discussions and alternatives previously discussed with regard to zipper tear strips 60 and 260 are also applicable to zipper tear strip 360. If desired, a sealed indicator 77 and/or closed padlock icons 78, as previously discussed, can be placed extending across a length of zipper tear strip 360.

Replacement panel 301 can be made of the same materials and have the same properties as previously discussed with regard to template 12 of zipper carton assembly 10. For example, replacement panel 301 can be comprised of a foldable sheet of material that (typically) retains a crease when folded. The foldable sheet can have a substantially flat configuration. For example, the sheet can comprise a paper-based material, such as paper, cardstock, paperboard or cardboard. In other embodiments, the sheet can be comprised of a synthetic, plastic, or other material (e.g., adapted to retain a crease when folded). The sheet can comprise a single, continuous, unitary structure; a composite; a laminate, an extrusion, or a base sheet having a coating on one or both opposing sides thereof. Thus, replacement panel 301 can be integrally formed as a single, continuous, unitary structure, i.e., be formed from one continuous sheet of material and not comprise two or more separately formed sheets of material secured or otherwise connected together.

Alternatively, replacement panel 301 can also be formed of two or more separately formed sheets that are connected together, such as through an adhesive or welding. Replacement panel 301 can have any suitable thickness. For instance, replacement panel 301 can have a thickness of up to, at least, or about 0.25 mm, 0.5 mm, 1 mm, 1.5 mm, 2 mm, 2.5 mm, 3 mm, and/or 5 mm or between any two of the foregoing. Thicknesses less than 0.25 mm or greater than 5 mm are also contemplated herein.

Replacement panel assembly 300 further comprises a first adhesive layer 370*a* disposed on the first side 389 of the mounting panel 380 and a second adhesive layer 370*b* disposed on the second side 366 of the attachment portion 364 of the replacement closure panel 350. In this configuration, the first adhesive layer 370*a* and the second adhesive layer 370*b* are disposed on opposing sides of the replacement panel 301. In some embodiments, and as depicted in FIG. 25A, replacement panel assembly 300 can further comprise a third adhesive layer 370*c* disposed on the first side 389 of the mounting panel 380 spaced apart from first adhesive layer 370*a*. For example, first adhesive layer 370*a* can be disposed at an upper end of mounting panel 380 while third adhesive layer 370*c* can be disposed at a lower end of mounting panel 380. Other numbers of adhesive layers, such as three of more, or a single enlarged adhesive layer can be used on mounting panel 380.

Adhesive layers 370 extend laterally between side edges 391 and 393 of mounting panel 380 and between side edges 365 and 367 of attachment portion 364. Adhesive layers 370 can extend all the way to the side edges or can terminate at a distance spaced back from the sides edges, such as by a distance of at least or less than 0.25 cm, 0.5 cm, 1 cm, 2 cm, 3 cm or other distances. In contrast to extending laterally between the side edges of mounting panel 380 and attachment portion 364, at least one, two, three or more spaced apart adhesive layers 370 could extend vertically between top and bottom edges of mounting panel 380 and/or attachment portion 364 or could be disposed at any desired angle on mounting panel 380 and/or attachment portion 364.

Adhesive layers 370 can be made of the same materials and have the same properties as adhesive layer 70 (FIG. 2) of zipper carton assembly 10 previously discussed. For example, in one embodiment adhesive layers 370 can each comprise a layer of glue or adhesive, double sided tape, and/or other sticky- or tacky-type material. For instance, adhesive layers 370 can comprise a synthetic rubber adhesive or rubberized glue adapted for permanent bonding and/or adhesion to plastic, paper, and/or other suitable material. Accordingly, adhesive layers 370 can have a strong initial tack for creating a "permanent bond" with a portion, discussed below, of the carton assembly on which replacement panel 301 is attached.

A removable liner 374*a*, 374*b*, and 374*c* can be disposed so as to cover all or at least a portion of adhesive layer(s) 370*a*, 370*b*, 370*c*, respectively. Removable liners 374 can comprise a polymeric sheet or strip covering adhesive layers 370. Removable liner 374 can also have at least one lifting edge at an end thereof. In at least one embodiment, the lifting edge can be easily accessible to fingertips for griping and removing removable liner 374. Moreover, removable liner 374 can have printing disposed thereon. For instance, the printing can comprise writing printed on a surface of removable liners 374 indicating an expiration date, instructions, or other information.

Sealable and Re-Sealable Carton Systems

As previously discussed, replacement panel assembly 300 can be selectively attached to a carton assembly to either reseal a previously opened carton assembly or to facilitate the initial sealing of a carton assembly. By way of example, in the embodiment depicted in FIG. 26, replacement panel assembly 300 is partially disposed within inner compartment 16 of carton assembly 10 after carton assembly 10 has been opened by the removal of zipper tear strip 60, as previously discussed with regard to FIGS. 11-13.

As previously discussed, carton assembly 10 and carton body 12 thereof comprise the encircling sidewall 14 that includes the front panel 80 and the rear panel 86. Floor 23 is disposed at the lower end 24 of the encircling sidewall 14, and the inner closure panel 30 projects from the upper edge of rear panel 86. Carton body 12 at least partially bounds compartment 16 which is accessed through access opening 22.

During use, replacement panel assembly 300 is partially disposed within compartment 16 of carton assembly 10 so that first side 389 of mounting panel 380 is aligned with and disposed against inner surface 15 of front panel 80. Adhesive layers 370*a* and 370*c* are used to secure mounting panel 380 to front panel 80 by first removing removable liners 374*a* and 374*c*, respectively. The combination of carton assembly 10 (or carton body 12 thereof) or other carton assemblies with replacement panel assembly 300 can be referred to herein as a carton system 302.

In one embodiment, mounting panel 380 of replacement panel assembly 300 can be the same or substantially the same configuration (in size and/or shape) as front panel 80. For example, mounting panel 380 can have the same height and width as front panel 80. This configuration enables replacement panel assembly 300 to be self-aligning when replacement panel assembly 300 is inserted within compartment 16 and pushed against front panel 80.

That is, as discussed below in further detail, replacement panel assembly 300 is designed to be attached to front panel 80 of carton assembly 10 so that replacement closure panel 350 is disposed outside of compartment 16, i.e., replacement closure panel 350 outwardly projects from the exposed top edge of front panel 80. By having mounting panel 380 have the same height as front panel 80, when mounting panel 380 is inserting in compartment 16 so that bottom edge 395 rests on floor 23 and mounting panel 380 is pushed against front panel 80, replacement panel assembly 300 is self-aligned so that replacement closure panel 350 is automatically disposed outside of compartment 16. Also, by having mounting panel 380 have the same width as front panel 80, replacement panel assembly 300 is self-aligned laterally within compartment 16.

In some embodiments, mounting panel 380 of panel assembly 300 can have a width extending between side edges 391 and 393 that is narrower than the width of front panel 80 by less than or at least 0.5 mm, 1 mm, 3 mm, 5 mm, 10 mm, or 20 mm or in a range between any two of the foregoing. Likewise, mounting panel 380 of panel assembly 300 can have a height that is taller than the height of front panel 80 by less than or at least 0.25 mm, 0.5 mm, 1 mm, 2 mm, 4 mm, or 6 mm, or 10 mm or in a range between any two of the foregoing. When such mounting panels 380 are disposed against the inner surface 15 of front panel 80, replacement closure panel 350 still remains disposed outside of the compartment 16.

In other embodiments, it is appreciated that mounting panel 380 could be shorter than and/or have a different configuration than front panel 80. In this design, however, it may be necessary to manually align mounting panel 380 as it is secured to inner surface 15 of front panel 80 so that replacement closure panel 350 remains disposed outside of compartment 16. For example, mounting panel 380 could have a maximum height that is shorter than the height of front panel 80 by less than or at least 5 mm, 10 mm, 2 cm, 5 cm, or 10 cm or in a range between any two of the foregoing. Other dimensions could also be used. Likewise, mounting panel 380 could have the configuration of a semi-circular, triangle, or other shapes that are not square or rectangular.

Figure 27:
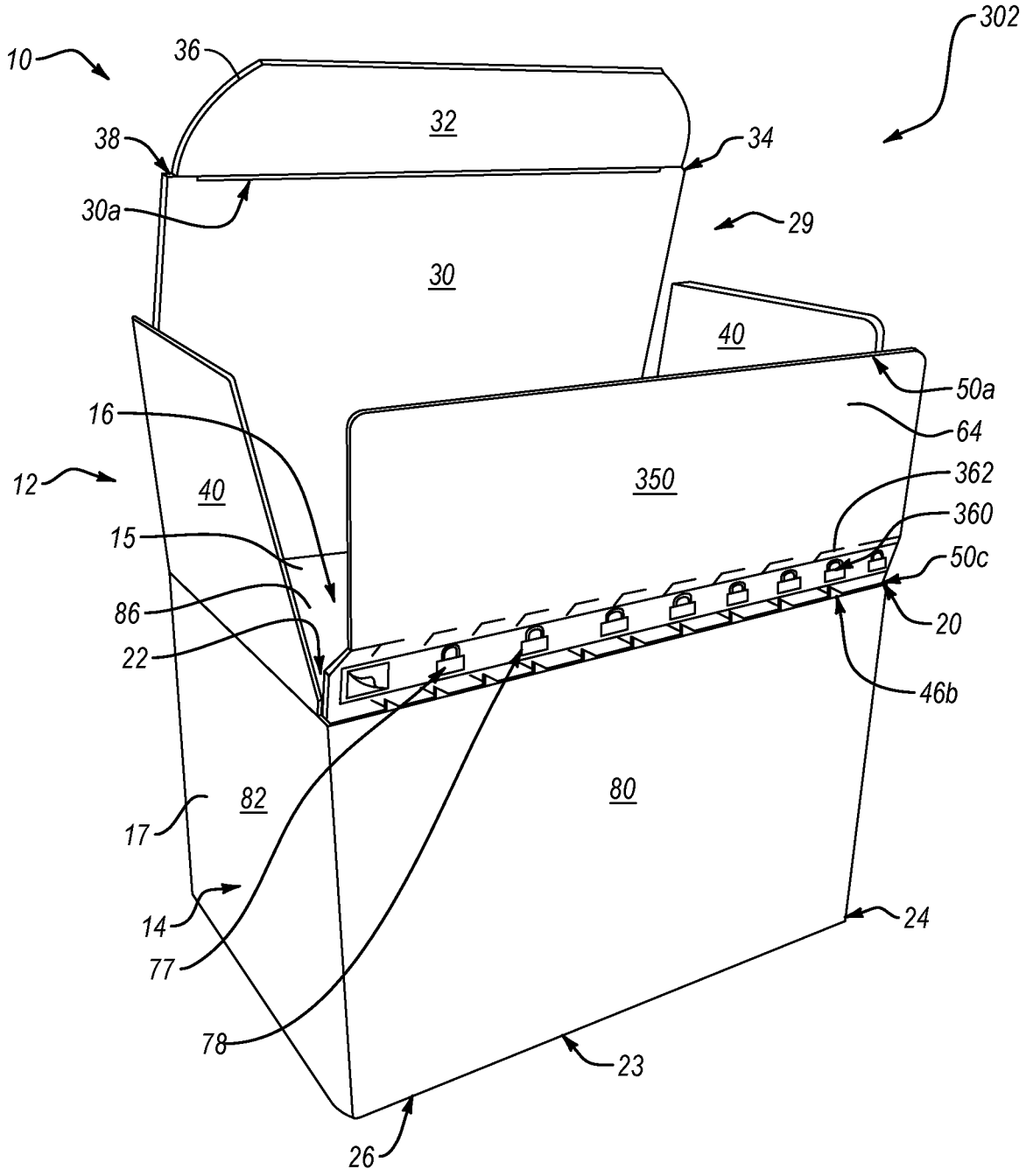
FIG. 27 is a front perspective view of the carton assembly and the replacement panel assembly of FIG. 26 secured together in an opened configuration.

FIG. 27 shows mounting panel 380 secured against inner surface 15 of front panel 80 so that replacement closure panel 350 is disposed outside of compartment 16. Because zipper tear strip 60 was previously removed from carton assembly 10 during the opening of carton assembly 10, jagged edge 46*b* is shown disposed on the top edge of front panel 80. In this assembled configuration, replacement closure panel 350 functions as a replacement for outer top closure panel 50 that was previously used in sealing closed carton assembly 10. That is, in the shown assembled configuration, carton assembly 10 can be closed and resealed by inwardly folding dust flaps 40 and then closing inner top closure panel 30, as shown in FIG. 28, using the same method as previously described for closing carton assembly 10.

Figure 28:
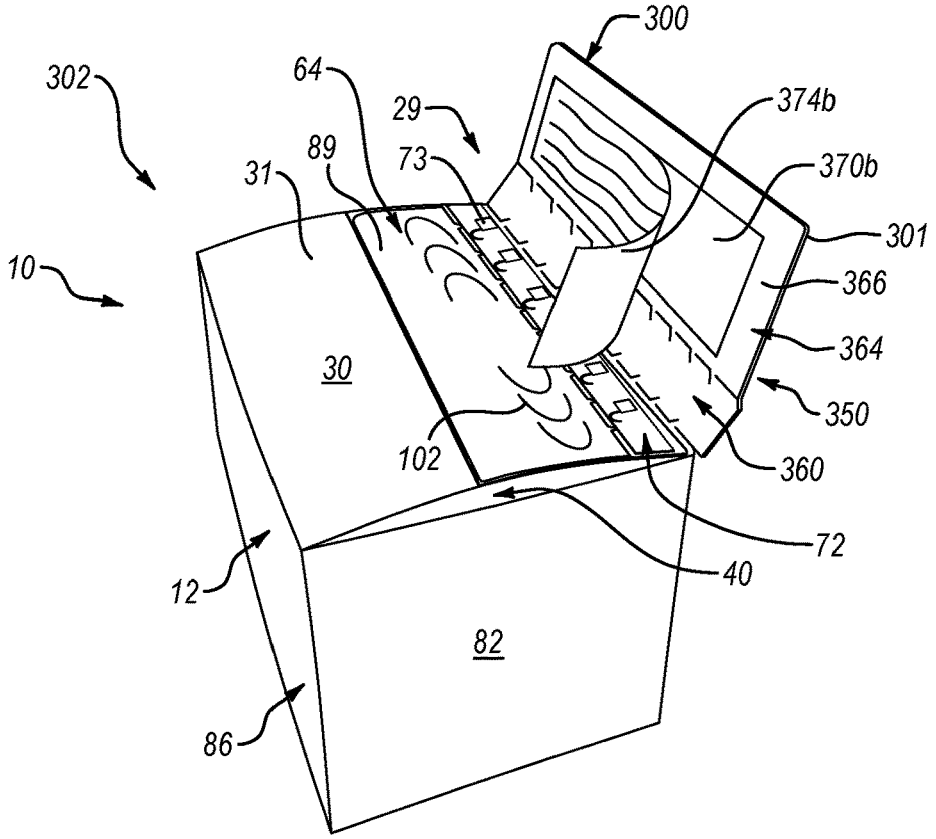
FIG. 28 is a perspective view of the carton assembly of FIG. 27 in a closed unsealed configuration.
Figure 29:
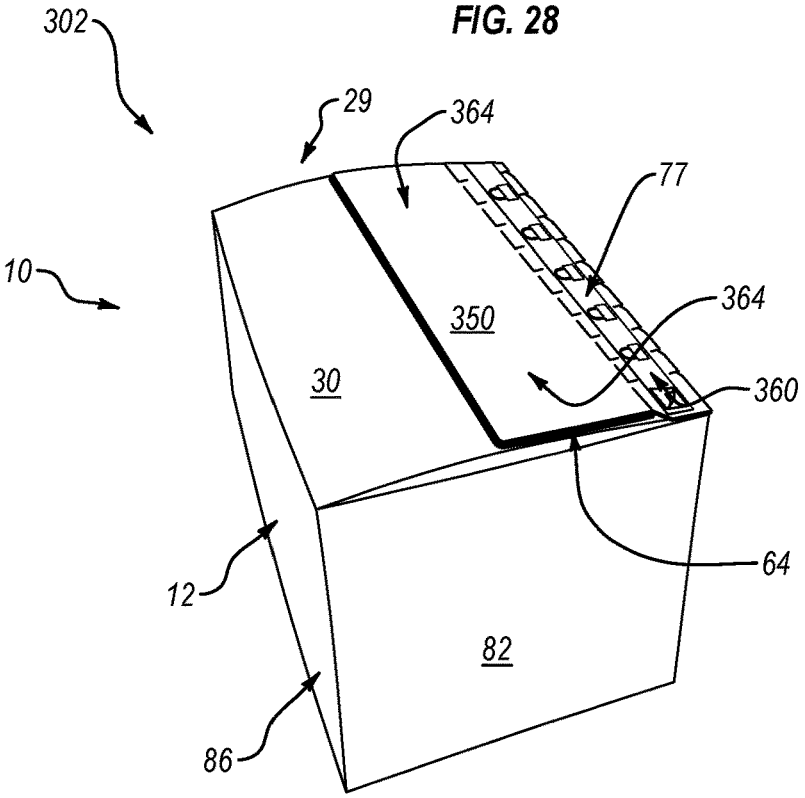
FIG. 29 is a perspective view of the carton assembly of FIG. 28 being sealed closed by the replacement panel assembly.

As illustrated in FIG. 28, attachment portion 64 of outer closure panel 50 may still be secured to outer surface 31 of inner closure panel 30. In other embodiments, all or portions of attachment portion 64 could be removed by being pulled, scrapped, torn or otherwise removed. With inner top closure panel 30 in the closed position, removable liner 374*b* can be removed to expose adhesive layer 370*b*. Replacement closure panel 350 can then be folded over, as depicted in FIG. 29, so that replacement closure panel 350 at least partially overlays inner top closure panel 30. In this configuration, adhesive layer 370*b* binds to inner top closure panel 30 by either binding directly outer surface 31 or indirectly by binding to attachment portion 64 or any remnants of attachment portion 64 after attachment portion 64 has been removed. As a result, carton assembly 10 is again in a sealed, closed state.

As depicted in FIGS. 29 and 30, to again reopen carton assembly 10 that is sealed closed by replacement panel assembly 300, zipper tear strip 360 can be removed. If it is again desired to seal carton assembly 10 closed, a new replacement panel assembly 300 can be inserted within compartment 16 and secured either directly to mounting portion 380 of the prior replacement panel assembly 300. Alternatively, if the prior mounting portion 380 is removed by pulling, tearing, scraping or the like, the new replacement panel assembly 300 can be secured directly to the inner surface of front panel 80. The above process can then be repeated.

As depicted in FIG. 28, one or more scores lines 102 can also be formed on outer surface 89 of attachment portion 64 so that adhesive layer 370*b* at least partially covers score line 102 when adhesive layer 370*b* is secured to outer surface 89 of attachment portion 64. Again, score lines 102 are used to indicate improper opening or attempts to improperly open sealed zipper carton assembly 10. This is achieved by facilitating the tearing of a portion of attachment portion 64 if an attempt is made to open sealed zipper carton assembly 10 by upwardly prying replacement closure panel 350 so that adhesive layer 370*b* detaches from attachment portion 64. The same numbers, configurations, layouts, uses, options and alternatives previously discussed with regard to score lines 102 and the use thereof on outer surface 31 of inner top closure panel 30 of zipper carton assembly 10 (FIG. 9) and outer surface 231 of inner top closure panel 230 of zipper carton assembly 200 (FIG. 21) are also applicable to using score lines 102 on outer surface 89 of attachment portion 64 of zipper carton assembly 10. In the same way and use as above, score lines 102 can also be formed on outer surface 289 of attachment portion 264 of zipper carton assembly 200 as depicted in FIG. 22.

Figure 30:
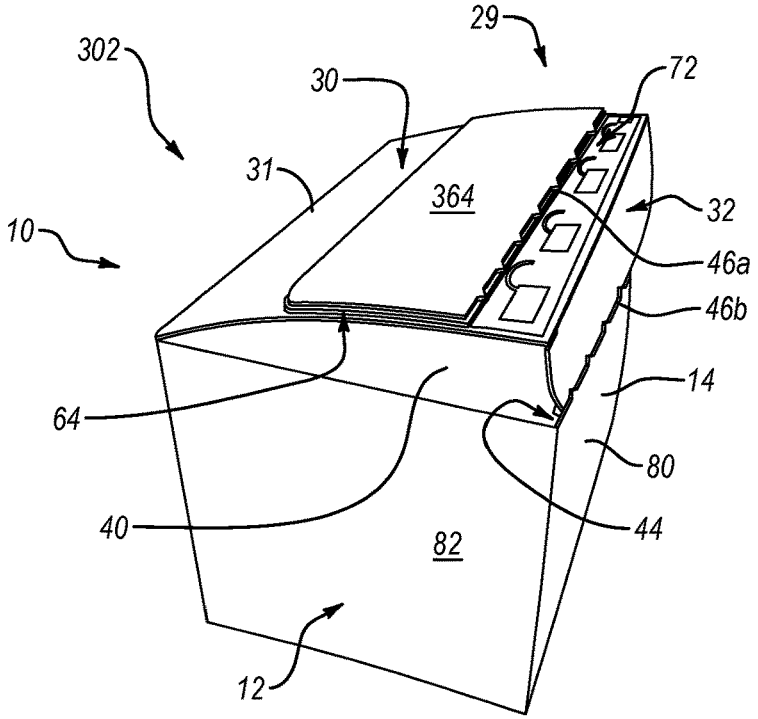
FIG. 30 is a perspective view of the carton assembly of FIG. 29 being unsealed by removal of the zipper tear strip of the replacement panel assembly.

As further depicted in FIGS. 28 and 29, in certain embodiments, zipper tear strip 360 can at least partially overlay unsealed indicator 72 (so as to at least partially cover unsealed indicator 72 and/or one or more opened padlock icons 73 thereof. However, as depicted in FIG. 30, when zipper tear strip 360 is removed, attachment portion 364 remains secured to and/or disposed at least partially over attachment portion 64, and, where applicable, unsealed indicator 72 is visible and/or displayed (on outer surface 31 of carton assembly 10 and/or inner closure panel 30 thereof).

Figure 31:
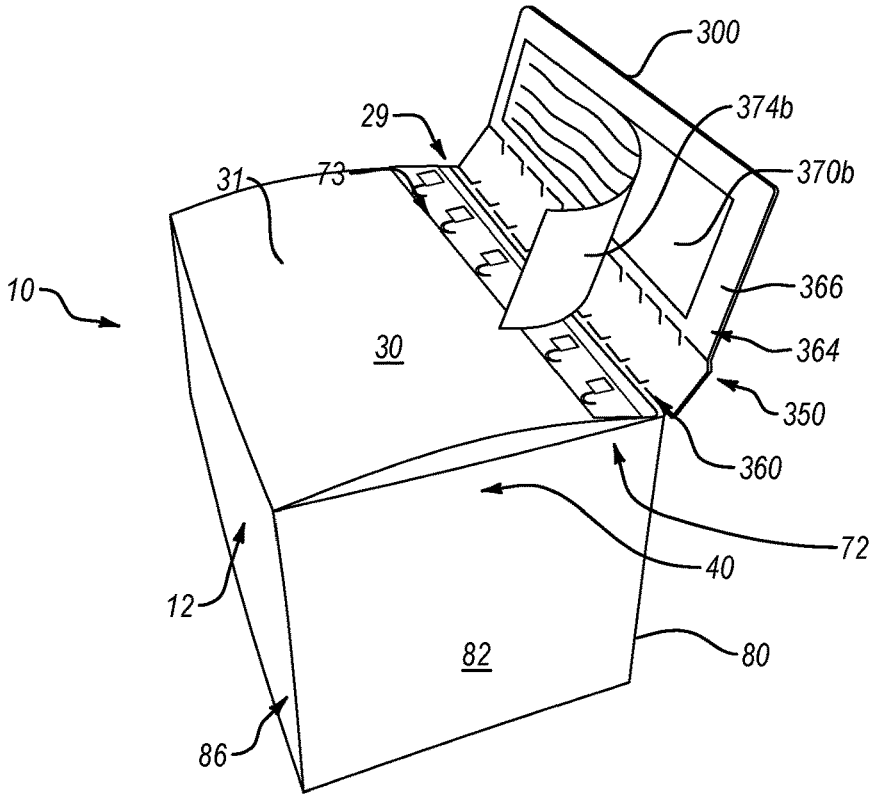
FIG. 31 is a perspective view of the replacement panel assembly of FIG. 25 being secured to an alternative embodiment of a carton assembly.

Although the above embodiment is discussed using replacement panel assembly 300 with carton assembly 10, replacement panel assembly 300 can be used in the same manner with carton assembly 210 and carton assemblies having other configurations. For example, depicted in FIG. 31 is another carton assembly 410 on which replacement panel assembly 300 can be used. Carton assembly 410 can be identical to carton assembly 10 or carton assembly 210, or modifications previously discussed thereto, except that that carton assembly 410 is formed without outer top closure panel 50 or 250. In the depicted embodiment, like elements between carton assembly 410 and carton assembly 10 are identified by like reference characters. Replacement panel assembly 300 can be used in the same manner as discussed above with regard to carton assembly 10 except that replacement panel assembly 300 can now be used for the initial sealing of carton assembly 410. That is, once replacement panel assembly 300 is secured to front panel 80 and inner top closure panel 30 is moved to the closed position, removable liner 374*b* can be removed and replacement closure panel 350 folded over so that adhesive layer 370*b* binds directly to outer surface 31 of inner top closure panel 30.

Methods of Sealing or Re-Sealing Carton Systems

Figure 26:
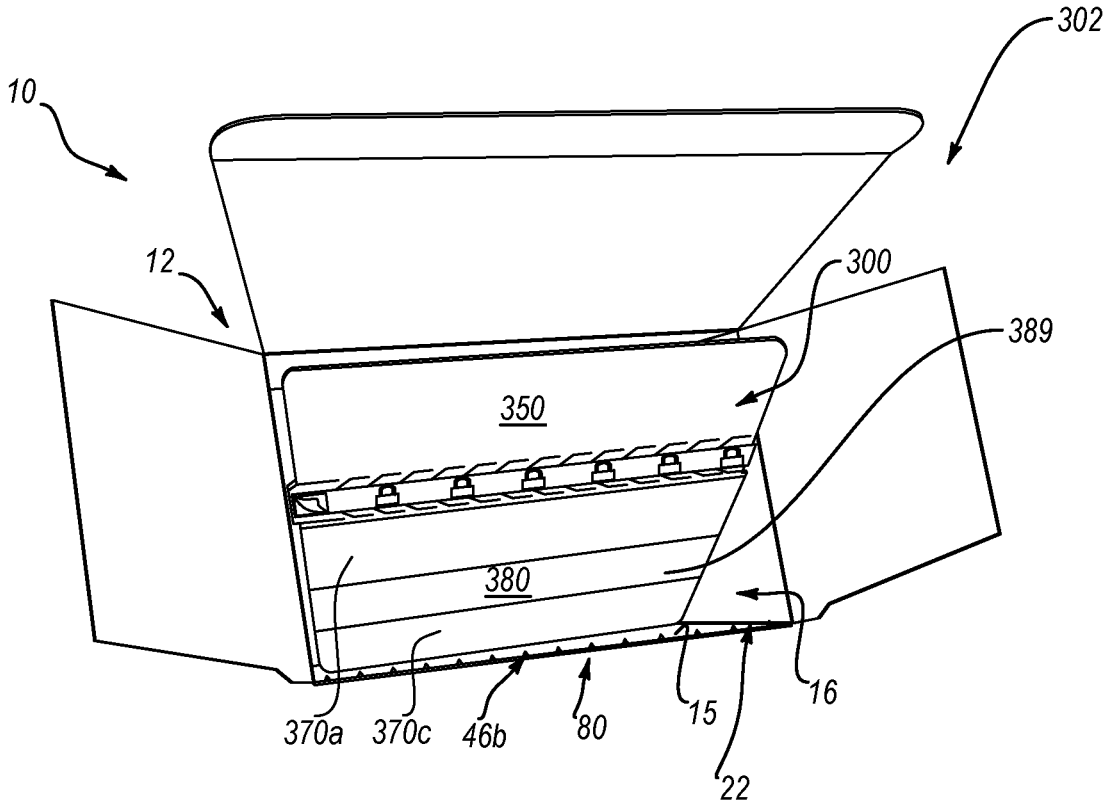
FIG. 26 is a top perspective view of a carton assembly having the replacement panel assembly of FIG. 25 partially disposed within the compartment thereof.

The method of sealing or resealing carton system 302, carton assembly 10, or carton body 12 will now be discussed in further detail. As depicted in FIG. 26, an embodiment can include inserting panel assembly 300 into carton assembly 10 or compartment 16 thereof (through access opening 22). Some embodiments can include removing (e.g., peeling away) removable liner(s) 374*a*, 374*c* (see FIG. 25A) from and/or thereby exposing adhesive layer(s) 370*a*, 370*c*. Certain embodiments can include aligning replacement panel assembly 300 or mounting panel 380 thereof with (inner surface 15 of) front panel 80 and/or disposing replacement panel assembly 300 or mounting panel 380 against (inner surface 15 of) front panel 80 such that first side 389 of replacement panel assembly 300 or mounting panel 380 thereof faces inner surface 15 of front panel 80.

Embodiments can also include securing (first side 389 of) mounting panel 380 (of (replacement panel 301) to inner surface 15 of encircling sidewall 14 or front panel 80 thereof (e.g., by first adhesive layer 370*a* and, optionally, third adhesive layer 370*c*). It will be appreciated that by so doing, a carton assembly 10 with zipper tear strip 60 removed can be substantially (functionally) similar to (or restored to a configuration substantially (functionally) similar to) a carton assembly 10 in which zipper tear strip 60 (and outer closure panel 50) are still attached at or to front closure panel 80.

As depicted in FIGS. 28 and 29, and as previously described in relation to FIGS. 8-10, carton assembly 10 can be closed by inwardly folding inner closure panel 30 (projecting from encircling sidewall 14 of the carton body 12) so that the inner closure panel 30 at least partially covers access opening 22 of or to compartment 16. Embodiments can also include inwardly folding replacement closure panel 350 of replacement panel 301 so that an adhesive (e.g., adhesive layer 370*b*) disposed on replacement closure panel 350 binds to inner closure panel 30 (or outer surface 31 thereof). Embodiments can also include removing (e.g., peeling away) removable liner 374*b* from adhesive layer 370*b* (thereby exposing adhesive layer 370*b*) and/or such that replacement closure panel 350 or attachment portion 364 thereof can be secured to (outer surface 31) of inner closure panel 30 by (means of) adhesive layer 370*b*. In so doing, zipper carton assembly 10/compartment 16 becomes sealed closed so that a blinded trial product (see product 96 of FIG. 7) cannot be accessed or tampered with until zipper carton assembly 10 is (again) opened by the removal of zipper tear strip 360.

Moreover, certain embodiments can include at least partially overlaying visual unsealed indicator 72 and/or one or more open padlock icon(s) 73 thereof (on outer surface 31 of carton assembly 10 and/or inner closure panel 30 thereof) with replacement closure panel 350 or zipper tear strip 360 thereof, thereby displaying visual sealed indicator 77.

As illustrated in FIG. 30, embodiments can include removing zipper tear strip 360, such that attachment portion 364 remains secured to and/or disposed at least partially over attachment portion 64, and, where applicable, visual unsealed indicator 72 is exposed, visible, and/or displayed (on outer surface 31 of carton assembly 10 and/or inner closure panel 30 thereof).

Figure 32:
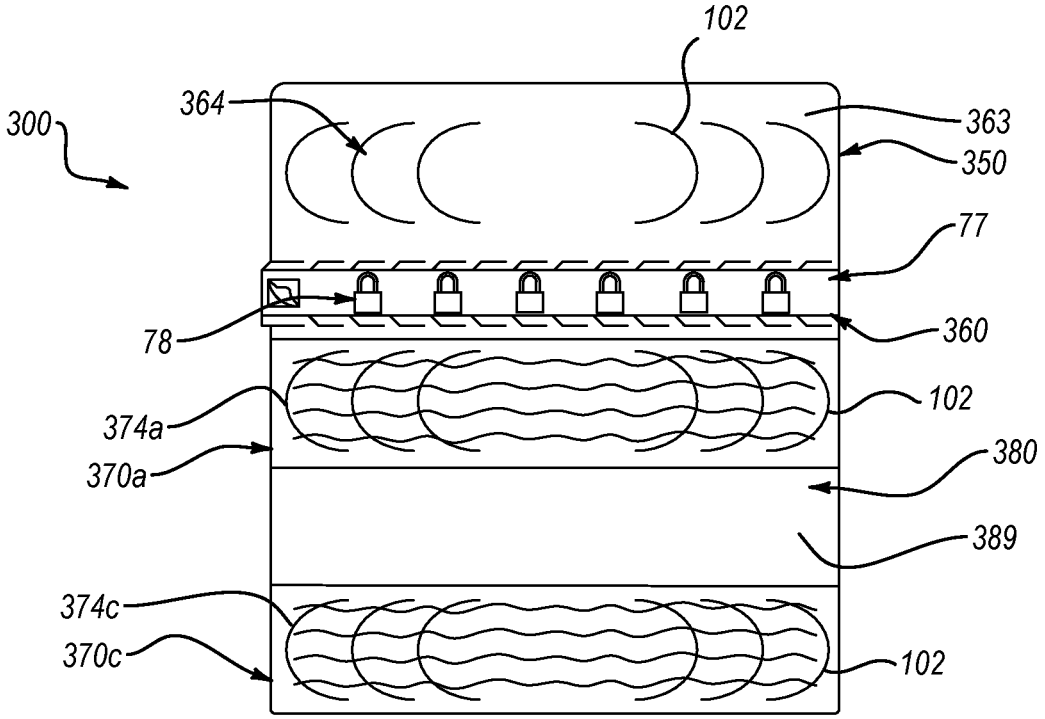
FIG. 32 is the front facing view of the replacement panel assembly shown in FIG. 25A with score lines formed thereon.

Finally, depicted in FIG. 32 is a top plan view of the first side of replacement panel assembly 300, as previously shown in FIG. 25A, except that replacement panel assembly 300 has now been modified to include score lines 102 thereon. Specifically, one or more score lines 102 is formed on or cut into first side 363 of attachment portion 364. These score lines 102 would be overlaid/engaged by adhesive layer 374*b* of replacement closure panel 350 or attachment portion 364 thereof of a further replacement closure panel 350 if it was necessary to reseal carton assembly 10 after zipper tear strip 360 of the initial replacement closure panel 350 was removed.

Furthermore, score lines 102 can be formed on or cut into first side 389 of mounting portion 380 of replacement panel assembly 300 by passing through first adhesive layer 370*a* and removable liner 374*a* and/or through first adhesive layer 370*c* and corresponding removable liner 374*c*. In this embodiment, adhesive layer 370*a* and/or 370*c* are still used to secure mounting portion 380 of replacement panel assembly 300 to inner surface 15 of encircling sidewall 14 (or front panel 80 thereof), as discussed above. However, attempts to improperly open sealed zipper carton assembly 10 by trying to manually pry mounting portion 380 of replacement panel assembly 300 off of inner surface 15 of encircling sidewall 14 will result in adhesive layer 370*a* and/or 370*b* remaining attached to encircling sidewall 14 and tearing of portions of mounting portion 380 about score lines 102. Such tearing will again indicate improper tampering of sealed zipper carton assembly 10 by either preventing proper resealing and/or by providing a visual indication of deformation of mounting portion 380.

It is noted that under traditional manufacturing constraints, score lines 102 can typically only be formed on one side of a flat blank used to form carton body 12 or replacement panel 301. Accordingly, score lines can be formed through adhesive layer 370*a* and/or 370*b* and into first side 389 of mounting portion 380 as opposed to being formed on inner surface 15 of encircling sidewall 14. However, in other embodiments, score lines 102 could be formed on inner surface 15 of encircling sidewall 14 and be positioned to be overlaid by adhesive layer 370*a* and/or 370*b*. In one alternative, it is also appreciated that one or more score lines 102 can be formed on or cut into first side 363 of replacement closure panel 350 or attachment portion 364 thereof by passing through second adhesive layer 370*b* and removable liner 374*b*.

Accordingly, each of the score lines 102 used on replacement panel assembly 300 can be used to indicate improper opening or attempts to improperly open sealed zipper carton assembly 10. The same numbers, configurations, layouts, uses, options and alternatives previously discussed with regard to score lines 102 herein are also applicable to using score lines 102 on replacement panel assembly 300.

CONCLUSION

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A sealable carton system comprising:

a carton body that bounds a compartment, the carton body comprising:

an encircling sidewall;

a floor disposed at a lower end of the encircling sidewall; and an inner closure panel projecting from an upper end of the encircling sidewall, the inner closure panel having an outside face with one or more score lines being formed into the outside face; and a replacement panel assembly comprising:

(i) a replacement panel, comprising:

(a) a mounting panel having a first side and an opposing second side; and (b) a replacement closure panel projecting from the mounting panel, the replacement closure panel comprising:

(1) an attachment portion having a first side and an opposing second side; and (2) a removable zipper tear strip disposed between the attachment portion and the mounting panel;

(ii) a first adhesive layer disposed on the first side of the mounting panel; and (iii) a second adhesive layer disposed on the second side of the attachment portion of the replacement closure panel, the first adhesive layer and the second adhesive layer being disposed on opposing sides of the replacement panel;

wherein the mounting panel of the replacement panel assembly is at least partially disposable within the compartment of the carton body and is secured by the first adhesive layer to the encircling sidewall, the second adhesive layer disposed on the second side of the attachment portion being secured to the outside face of the inner closure panel so as to at least partially cover the one or more score lines.

2. The sealable carton system of claim 1, wherein the encircling sidewall comprises a front panel and a rear panel, the inner closure panel projecting from an upper end of the rear panel, and the mounting panel of the replacement panel being secured by the first adhesive layer to an inner surface of the front panel.

3. The sealable carton system of claim 1, further comprising a visual indicator of unsealed configuration disposed on an outer surface of the inner closure panel, the visual indicator of unsealed configuration comprising printed indicia, the inner closure panel being foldable into a closed configuration, the replacement closure panel being foldable over the folded inner closure panel such that the removable zipper tear strip at least partially covers the visual indicator of unsealed configuration.

4. The sealable carton system of claim 1, wherein the carton body further comprises a plurality of spaced apart protrusions extending from an upper end of the front panel, the plurality of protrusions comprising remnants of a removed zipper tear strip.

5. A sealable carton system, comprising:

a carton body that bounds a compartment, the carton body comprising:

an encircling sidewall that includes a front panel and a rear panel disposed opposite the front panel, the front panel having an inside face facing the compartment;

a floor disposed at a lower end of the encircling sidewall; and an inner closure panel projecting from an upper end of the rear panel; and a replacement panel comprising:

a mounting panel at least partially disposed within the compartment of the carton body and secured by a first adhesive layer to the inside face of the front panel; and a replacement closure panel projecting from the mounting panel so as to be at least partially disposed outside of the compartment of the carton body, the replacement closure panel comprising:

an attachment portion having a second adhesive layer disposed thereon; and a removable zipper tear strip disposed between the attachment portion and the mounting panel.

6. The sealable carton system of claim 5, wherein the replacement closure panel is secured to the inner closure panel by the second adhesive layer.

7. The sealable carton system of claim 5, further comprising:

the inner closure panel having an interior surface and an exterior surface; and an attachment portion of a panel having an interior surface and an exterior surface, the interior surface of the attachment portion of the panel being secured by a third adhesive layer to the exterior surface of the inner closure panel.

8. The sealable carton system of claim 7, further comprising one or more score lines being formed into the exterior surface of the inner closure panel, at least a portion of the one or more score lines being covered by the third adhesive layer.

9. The sealable carton system of claim 7, further comprising:

one or more score lines being formed into the exterior surface of the attachment portion of the panel; and the attachment portion of the replacement closure panel being secured to the attachment portion of the panel by the second adhesive layer so that the second adhesive layer at least partially covers the one or more score lines formed into the exterior surface of the attachment portion of the panel.

10. The sealable carton system of claim 5, wherein the mounting panel has a bottom edge extending between a first side edge and an opposing second side edge, the mounting panel being positioned so that the entire bottom edge is disposed within the compartment of the carton body.

11. The sealable carton system of claim 5, wherein the mounting panel has a first side disposed within the compartment of the carton body and facing the inside face of the front panel and an opposing second side disposed within the compartment and facing toward the rear panel, the first side being secured by the first adhesive layer to the inside face of the front panel.

12. A sealable carton system, comprising:

a carton body that bounds a compartment, the carton body comprising:

an encircling sidewall that includes a front panel and a rear panel disposed opposite the front panel, the encircling sidewall having an inside face facing the compartment;

a plurality of spaced apart protrusions extending from an upper end of the front panel, the plurality of protrusions comprising remnants of a removed zipper tear strip;

a floor disposed at a lower end of the encircling sidewall; and an inner closure panel projecting from an upper end of the rear panel; and a replacement panel comprising:

a mounting panel at least partially disposed within the compartment of the carton body and secured by a first adhesive layer to the inside face of the encircling sidewall; and a replacement closure panel projecting from the mounting panel so as to be at least partially disposed outside of the compartment of the carton body, the replacement closure panel comprising:

an attachment portion having the second adhesive layer disposed thereon; and a removable zipper tear strip disposed between the attachment portion and the mounting panel.

13. The sealable carton system of claim 12, further comprising a visual indicator of unsealed configuration disposed on an outer surface of the inner closure panel, the visual indicator of unsealed configuration comprising printed indicia, the inner closure panel being foldable into a closed configuration, the replacement closure panel being foldable over the folded inner closure panel such that the removable zipper tear strip at least partially covers the visual indicator of unsealed configuration.

14. The sealable carton system of claim 12, wherein the mounting panel is secured by the first adhesive layer to the inside face of the front panel.

* * * * *